US008313218B2

(12) United States Patent
Hong et al.

(10) Patent No.: US 8,313,218 B2
(45) Date of Patent: Nov. 20, 2012

(54) GAP MEMBER, LENS AND LIGHTING DEVICE HAVING THE SAME

(75) Inventors: Sung Ho Hong, Seoul (KR); Hyun Min Kim, Seoul (KR); Dong Nyung Lim, Seoul (KR); Eun Hwa Kim, Seoul (KR)

(73) Assignee: LG Innotek, Co., Ltd., Seoul (KR)

( * ) Notice: Subject to any disclaimer, the term of this patent is extended or adjusted under 35 U.S.C. 154(b) by 316 days.

(21) Appl. No.: 12/874,987

(22) Filed: Sep. 2, 2010

(65) Prior Publication Data

US 2011/0188244 A1 Aug. 4, 2011

Related U.S. Application Data

(63) Continuation-in-part of application No. 12/652,680, filed on Jan. 5, 2010, now Pat. No. 8,167,462, and a continuation-in-part of application No. 12/656,501, filed on Feb. 1, 2010.

(30) Foreign Application Priority Data

| | | |
|---|---|---|
| May 25, 2009 | (KR) | 10-2009-0045342 |
| Jun. 5, 2009 | (KR) | 10-2009-0049987 |
| Apr. 9, 2010 | (KR) | 10-2010-0032961 |
| Apr. 10, 2010 | (KR) | 10-2010-0033043 |

(51) Int. Cl.
*F21V 5/00* (2006.01)
*F21V 31/00* (2006.01)

(52) U.S. Cl. ..... 362/336; 362/311.02; 362/311.06; 362/337; 362/267

(58) Field of Classification Search ..... 362/311.02, 362/311.06, 311.09, 311.1, 335, 336, 337, 362/339, 340, 267
See application file for complete search history.

(56) References Cited

U.S. PATENT DOCUMENTS

| | | | | |
|---|---|---|---|---|
| 4,991,073 | A | 2/1991 | Levin | |
| 5,806,955 | A | 9/1998 | Parkyn, Jr. et al. | |
| 6,623,150 | B2 * | 9/2003 | Roller et al. | 362/520 |
| 2009/0296405 | A1 * | 12/2009 | Tetsuo | 362/308 |

FOREIGN PATENT DOCUMENTS

| | | | |
|---|---|---|---|
| KR | 10-2009-0029056 | A | 3/2009 |
| WO | WO 2007/111547 | A1 | 10/2007 |
| WO | WO 2009/036964 | A1 | 3/2009 |

* cited by examiner

*Primary Examiner* — Laura Tso
(74) *Attorney, Agent, or Firm* — McKenna Long & Aldridge LLP

(57) ABSTRACT

A lighting device and a gap member and a lens used in a lighting device. The lens may include a circular incident surface that has a furrow surface crossing a surface and prism surfaces formed at both sides of the furrow surface; and an exit surface that reflects and transmits light traveling inside through the incident surface to the outside. The gap member may include a ring-shaped reflective portion having a declined surface toward the center; and a ring-shaped wall extending downward coaxially with the reflective portion, and has a flat ring shape. The lighting device may include a substrate; a light emitting unit including a plurality of LEDs mounted on the substrate; a case body accommodating the light emitting unit; a lens disposed on the light emitting unit; a first waterproof ring disposed around the lens; and a case cover having an opening that exposes the lens, and combined with the case body and the first waterproof ring.

33 Claims, 24 Drawing Sheets

GAP MEMBER, LENS AND LIGHTING DEVICE HAVING THE SAME

This application is a Continuation-in-part of application Ser. No. 12/652,680, filed Jan. 5, 2010, which claims priority to Korean Application No. 10-2009-0045342 filed May 25, 2009 and Continuation-in-part of application Ser. No. 12/656,501 filed Feb. 1, 2010, which claims priority to Korean Application No. 10-2009-0049987 filed Jun. 5, 2009, all of which are hereby incorporated by reference. This application also claims priority to Korean Application Nos. 10-2010-0032961 filed Apr. 9, 2010 and 10-2010-0033043 filed Apr. 10, 2010, both of which are hereby incorporated by reference.

BACKGROUND OF THE INVENTION

1. Field of the Invention

An embodiment relates to a gap member, a lens, and a lighting device having the same, in more detail, a gap member for a lighting device, a lens for a lighting device which has efficient luminance distribution on the surface through which light travels, and a lighting device having the gap member and the lens.

2. Description of the Related Art

Since LEDs (Light Emitting Diode) consume small power, has a long life span, and can be operated at a low cost, they are used as light sources for various electronic components, electronic display boards, and lighting devices etc. However, it is required to overcome problems, such as high prices, vulnerability to heat or humidity, low color rendering, and low luminance, in order to replace the existing light sources with the LEDs.

Lighting devices for achieve desired discharge light characteristics by additionally providing a lens to the LEDs have been proposed in the art. In general, there are lenses for diffusing light to achieve a wide radiation surface and lenses for concentrating light having high luminance on a wide radiation surface, in lenses for lighting devices.

Further, a reflective plate is increasingly formed around the LEDs to increase efficiency of the light radiated from LED lamps, and a member that spaces a lens and an LED by a predetermined distance is provided in some lighting devices additionally equipped with the lens in order to prevent contact between the lens and the LED.

SUMMARY OF THE INVENTION

An embodiment provides a gap member for a lighting device in which a lens included in a lighting device does not directly press LEDs.

An embodiment provides a gap member for a lighting device that has a reflective plate to increase efficiency of light emitted from the lighting device.

An embodiment provides a gap member for a lighting device that improve withstand voltage of the lighting device.

An embodiment provides a gap member for a lighting device that has a reflective plate to increase efficiency of light emitted from the lighting device and improves to tollgate resistance of the lighting device, in which a lens of the lighting device does not directly press LEDs.

An embodiment provides a lens that can fit luminance of a radiation surface to desired luminance and minimize power consumption, thereby achieving an efficient lighting device.

An embodiment provides a lighting device including a lens for a lighting device which makes it possible to achieve efficient luminance distribution on a surface where light is radiated, and/or a gap member for a lighting device.

An embodiment provides a lighting device having excellent heat dissipation and waterproof characteristics.

An embodiment provides a lighting device that can easily achieve desired discharge light distribution.

An embodiment provides a lighting device having improved withstand voltage.

An embodiment provides a lighting device that can be easily maintained.

A lens according to an embodiment includes: a circular incident surface that has a furrow surface crossing a surface and prism surfaces formed at both sides of the furrow surface; and an exit surface that reflects and transmits light traveling inside through the incident surface to the outside A lens according to an embodiment includes: a circular incident surface that is perpendicular to a light axis; and an exit surface that reflects and transmits light traveling inside through the incident surface, in which the incident surface has a light diffusion surface that diffuses the light to the outside and a luminance reinforcement surface that is formed across the center of the incident light in the longitudinal direction of the light diffusion surface to compensate luminance at the center portion of a radiation surface.

A lens according to an embodiment includes: a circular incident surface that is perpendicular to a light axis; and an exit surface that reflects and transmits light traveling inside through the incident surface, in which a radiation region in the surface where the light is radiated from the lens is an approximate rectangle, the length of the long side of the approximate rectangle is 2.5 times the height from the light source to the radiation surface, the length of the short side of the approximate rectangle is 1.6 times the height from the light source to the radiation surface, and UP/RT is 0.88.

A gap member according to an embodiment includes: a ring-shaped reflective portion having a declined surface toward the center; and a ring-shaped wall extending downward coaxially with the reflective portion, and has a flat ring shape.

A lighting device according to an embodiment includes: a substrate; a light emitting unit including a plurality of LEDs mounted on the substrate; a case body accommodating the light emitting unit; a lens disposed on the light emitting unit; a first waterproof ring disposed around the lens; and a case cover having an opening that exposes the lens, and combined with the case body and the first waterproof ring.

An embodiment may provide a gap member for a lighting device in which a lens included in a lighting device does not directly press LEDs.

An embodiment may provide a gap member for a lighting device that has a reflective plate to increase efficiency of light emitted from the lighting device.

An embodiment may provide a gap member for a lighting device that improve withstand voltage of the lighting device.

An embodiment may provide a gap member for a lighting device that has a reflective plate to increase efficiency of light emitted from the lighting device and improves to tollgate resistance of the lighting device, in which a lens of the lighting device does not directly press LEDs.

An embodiment may provide a lens that can fit luminance of a radiation surface to desired luminance and minimize power consumption, thereby achieving an efficient lighting device.

An embodiment may provide a lighting device including a lens for a lighting device which makes it possible to achieve efficient luminance distribution on a surface where light is radiated, and/or a gap member for a lighting device.

An embodiment may provide a lighting device that uses a case having excellent heat dissipation effect, and has heat dissipation characteristics by attaching a heat dissipation plate to the bottom of a light emitting unit.

An embodiment may provide a lighting device having excellent waterproof characteristics, by including a waterproof ring.

An embodiment may provide a lighting device that can easily achieve desired discharge light distribution.

An embodiment may provide a lighting device that makes it easy to replace a lens.

An embodiment may provide a lighting device having improved withstand voltage.

An embodiment may provide a lighting device that is easily maintained.

DETAILED DESCRIPTION OF THE PREFERRED EMBODIMENTS

In describing the embodiments, the reference of the "above" or "below" of each layer is, if not specifically stated, is assumed that the side where a lens 140 is the "above" and the side where a light emitting unit 101 is the "below".

Figure 31:
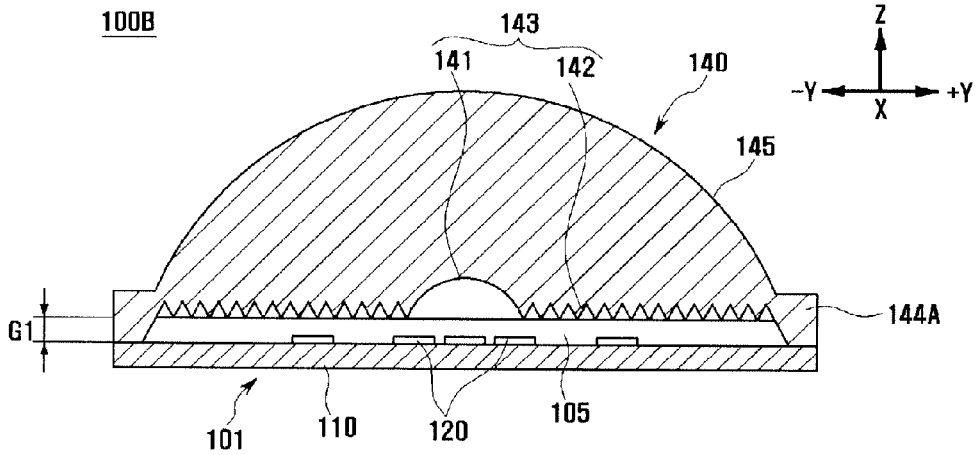
FIG. 31 is a side cross-sectional view showing a lighting unit according to a third embodiment.

In describing the embodiments, although a lighting unit 100 implies the component including a lens 140, a gap member 130, and a light emitting unit 101, when a specific gap member does not exist, as in FIG. 31, the lighting unit 100 implies the component including the lens 140 and the light emitting unit 101. The first to fifth embodiments describe the lighting unit 100, and the others, including the sixth embodiment, describe lighting devices.

When an axis of coordinates representing a space is shown in the figures, the axis of coordinates will be first described. The thickness or size of each layer was exaggerated, omitted, or schematically shown in the figures, for the convenience and clarity of description. Further, the size of each component does not completely represent the actual size. Embodiments are described hereafter with reference to the accompanying drawings, as follows.

Figure 1:
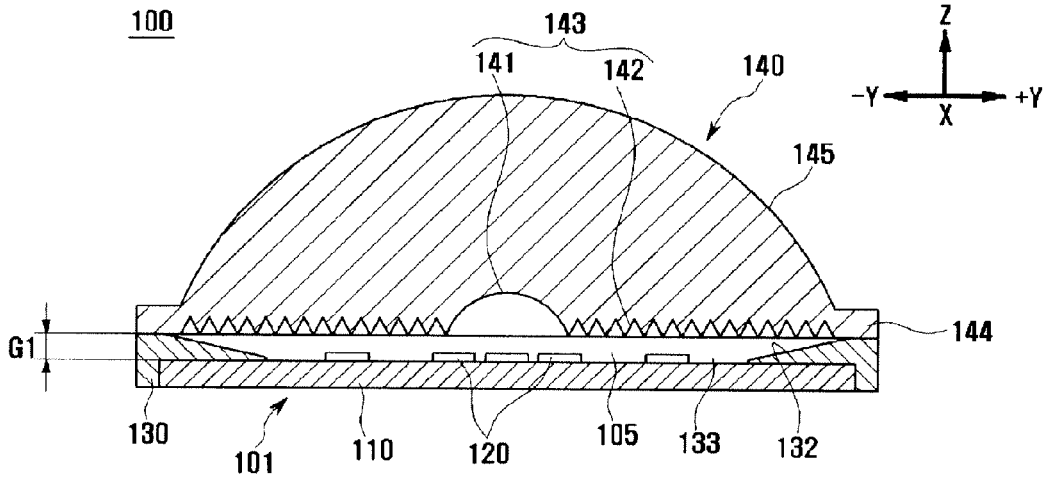
FIG. 1 is a side view showing a lighting unit according to a first embodiment.
Figure 2:
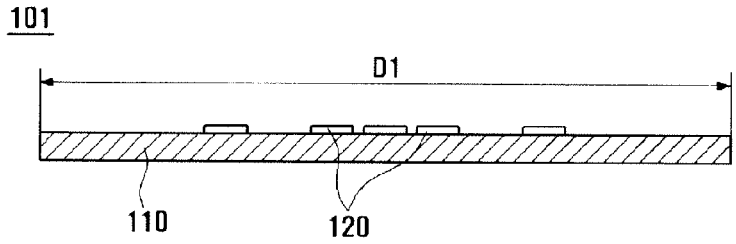
FIG. 2 is a side cross-sectional view of a light emitting unit of FIG. 1.
Figure 3:
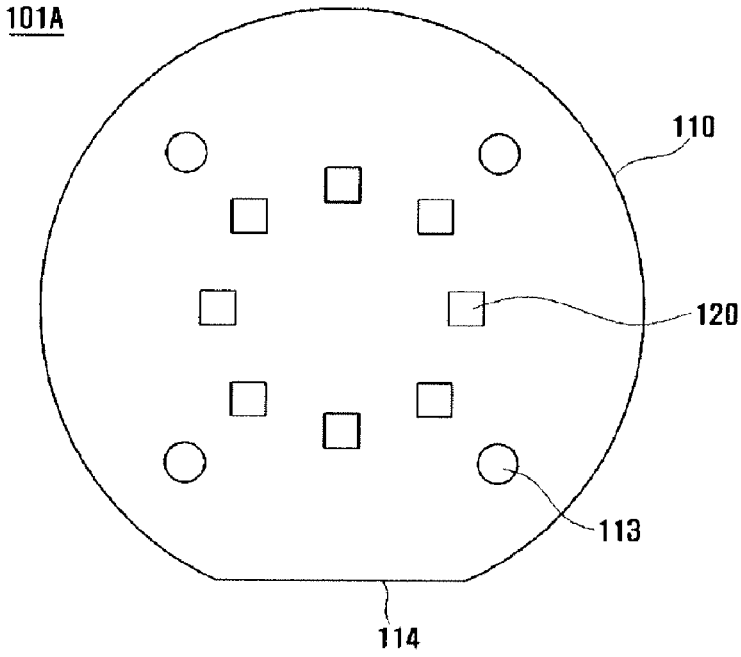
FIG. 3 is a plan view of the light emitting unit of FIG. 1.
Figure 4:
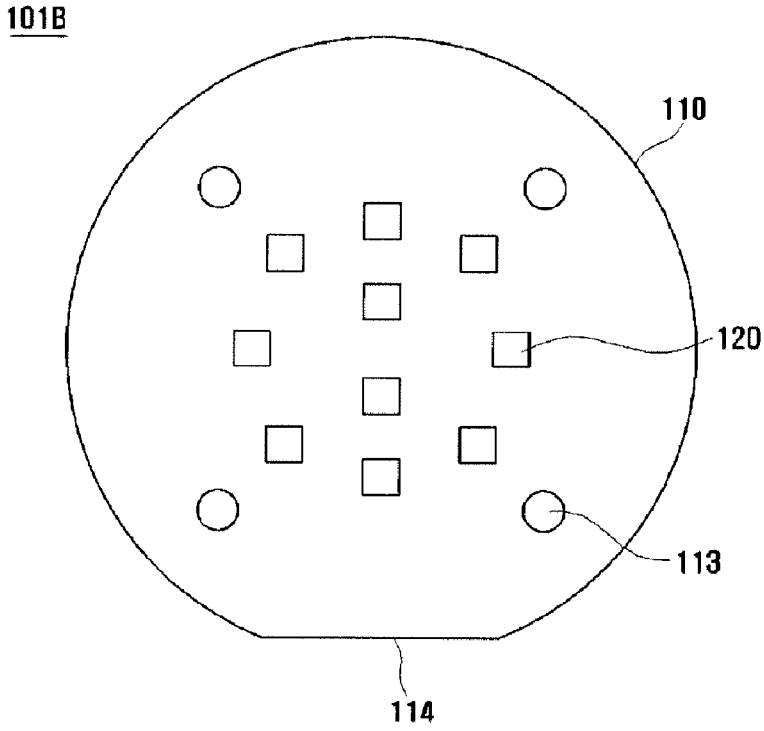
FIG. 4 is a view showing another example of the light emitting unit of FIG. 1.
Figure 5:
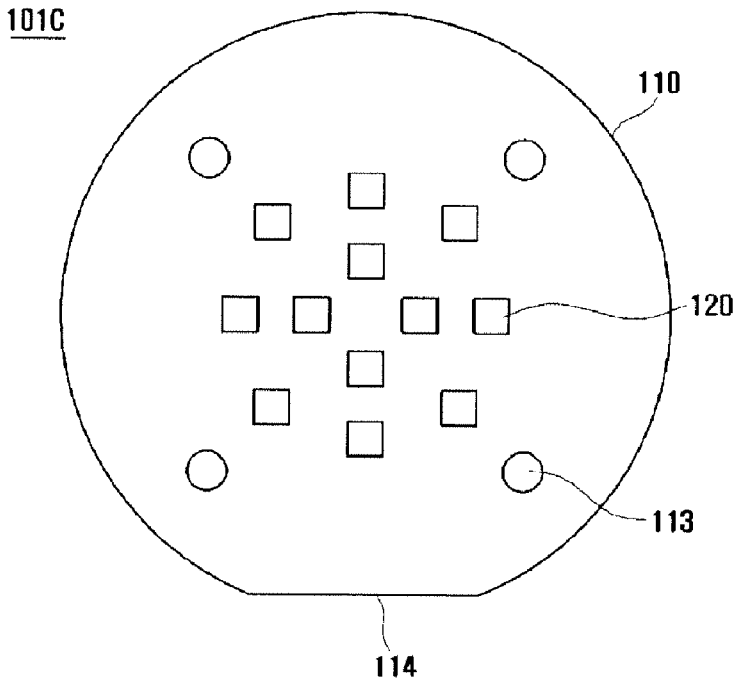
FIG. 5 is a view showing another example of the light emitting unit of FIG. 1.
Figure 6:
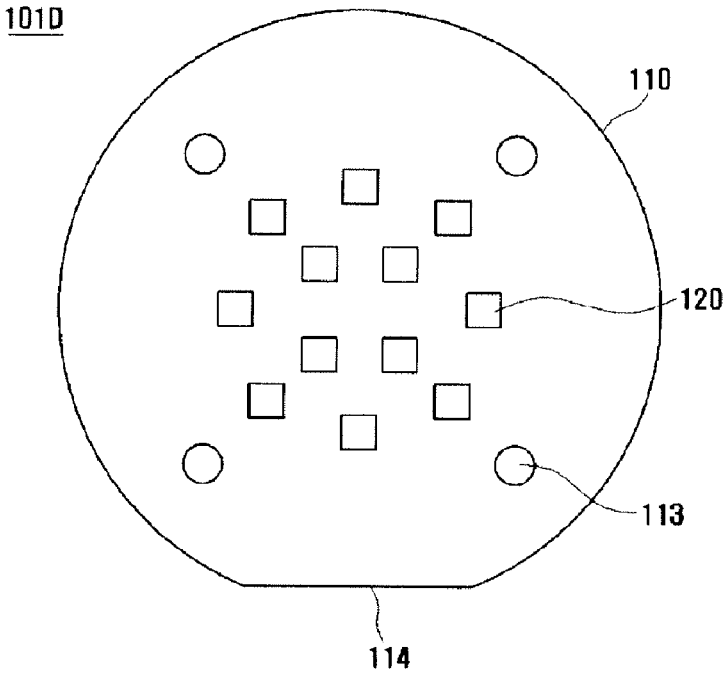
FIG. 6 is a view showing another example of the light emitting unit of FIG. 1.

FIG. 1 is a side view showing a lighting unit according to a first embodiment, FIG. 2 is a side cross-sectional view of a light emitting unit of FIG. 1, FIG. 3 is a plan view of the light emitting unit 101 of FIG. 1, FIG. 4 is a view showing another example of the light emitting unit 101 of FIG. 1, FIG. 5 is a view showing another example of the light emitting unit 101 of FIG. 1, and FIG. 6 is a view showing another example of the light emitting unit of FIG. 1.

Referring to FIG. 1, a lighting unit 100 includes a light emitting unit 101, a gap member 130, and a lens 140. The lighting unit 100 can be mounted in street lamps disposed at regular intervals, exterior lamps, such as outdoor lamps, and illuminate with appropriate light distribution and luminance distribution for the front of the external lamps and the regions between street lamps and outdoor lamps.

The light emitting unit 101 is equipped with a plurality of LEDs 120 on a substrate 110 and the arrangement of the LEDs 120 can be modified in various ways. Although FIGS. 2 to 6 mainly show the substrate 110 and the LEDs 120 in the components of the light emitting unit 101, as shown in FIGS. 33, 36, 37 and 39, the light emitting unit 101 may additionally include a lead electrode 170, a protective tube 180, and a connecting terminal 190.

The substrate may be an aluminum substrate, a ceramic substrate, a metal core PCB, and a common PCB etc. Further, the substrate 110 is made of a material efficiently reflecting light, or the surface may have a color efficiently reflecting light, such as white and silver. The LEDs 120 include a white Led, or it is possible to selectively use color LEDs, such as a red LED, a blue LED, and a green LED. The light emitting angle of the LED 120 is 120°~160° or may include a Lamertian shape (perfect diffused surface).

The substrate 110 of the light emitting unit 101, as shown in FIGS. 2 and 3, is a circular plate having a predetermined diameter D1 and the diameter D1 may have a size that can be accommodated under the gap member 130. A flat portion 114 may be formed at a predetermined portion of the outer circumference of the substrate 110, in which the flat portion 114 indicates the joint between components or prevents rotation there between.

A plurality of screw holes 113 may be formed in the substrate 110 to fasten the substrate 110 to structures, such as street lamps and outdoor lamps, or fasten the substrate 110 to the case of the lighting unit 110, by screwing screws into the screw holes 113. In this configuration, not only screws, but rivets or hooks may be inserted in the screw holes 113. The substrate 110 may not have the screw holes 113.

The light emitting unit 101A of FIG. 3 has eight LEDs 120 arranged on the substrate 110, and for example, the eight LEDs 120 may be arranged at regular intervals on a circle having a predetermined radius from the center of the substrate 110. The eight LEDs 120 may be arranged not only the circle, but an ellipse or a rectangular.

The light emitting unit 101B of FIG. 4 has ten LEDs 120 arranged on the substrate 110, and for example, an example in which eight LEDs 120 are arranged at regular intervals on a circle having a predetermined radius from the center of the substrate and two LEDs are arranged inside the circle is shown.

The light emitting unit 101C of FIG. 5 has twelve LEDs 120 arranged on the substrate 110, and for example, an example in which eight LEDs 120 are arranged at regular intervals on a circle having a predetermined radius from the center of the substrate and four LEDs are arranged at regular intervals on a coaxial circle having a radius smaller than the above circle is shown.

According to the light emitting unit 101D shown in FIG. 6, as compared with FIG. 5, all of the LED 120 on the smaller circle may be rotated at 45° from the center of the substrate.

The arrangements of LED 120 shown in FIGS. 3 to 6 are examples, the distance between the LEDs 120 arranged on the circles may not be uniform in accordance with desired shapes of the radiation surface, and the shape of arrangement and the number of the LEDs 120 on the substrate 110 may be changed in accordance with intensity of light, light distribution, and luminance distribution, and may also be changed with the technological range of the embodiments. If the term, light emitting unit 101, is used in the drawings or the specification without specifying the light emitting units 101A, 101B, 101C, and 101D having specific arrangements of the LEDs 120, it should be understood that the term represents the light emitting units having those arrangements.

Figure 7:
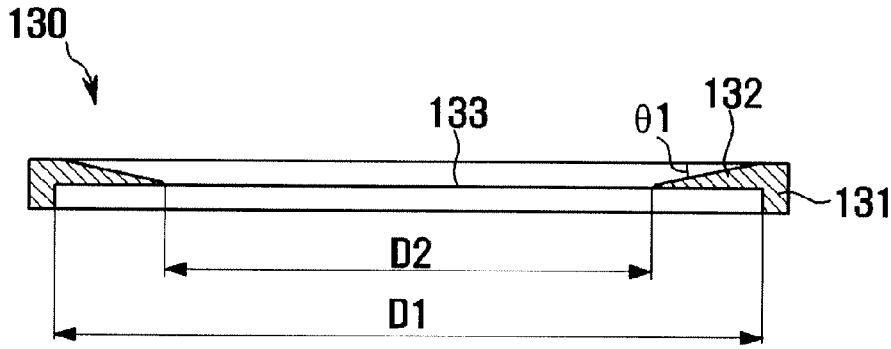
FIG. 7 is a side cross-sectional view a gap member of FIG. 1.
Figure 8:
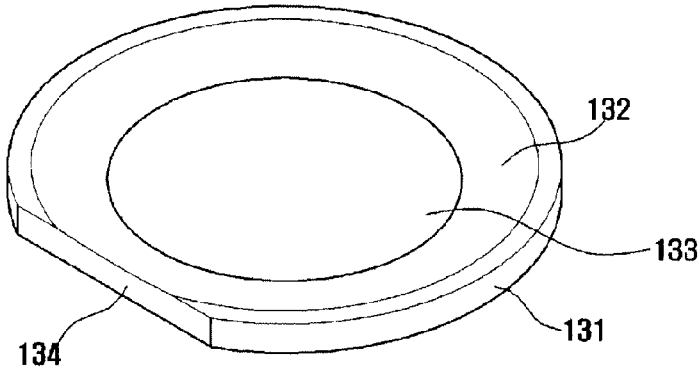
FIG. 8 is a perspective view of the gap member of FIG. 1.
Figure 9:
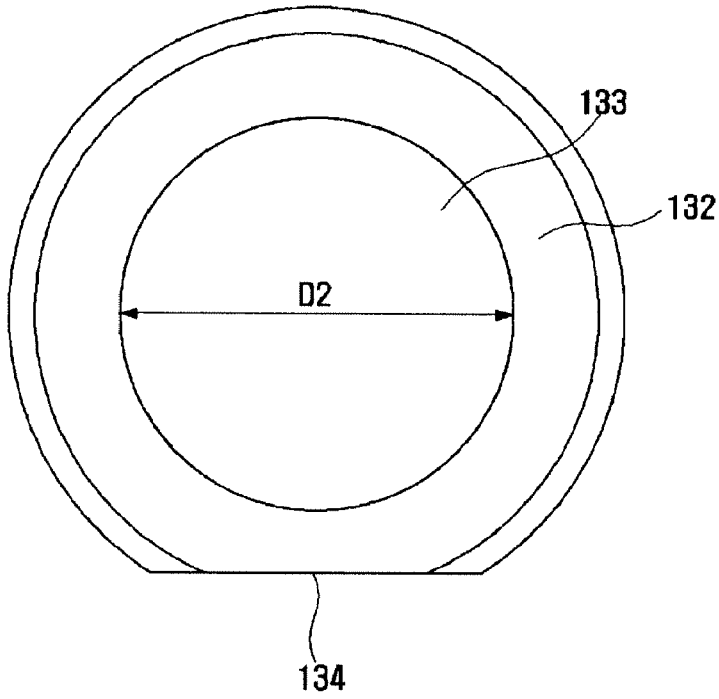
FIG. 9 is a plan view of the gap member of FIG. 1.
Figure 10:
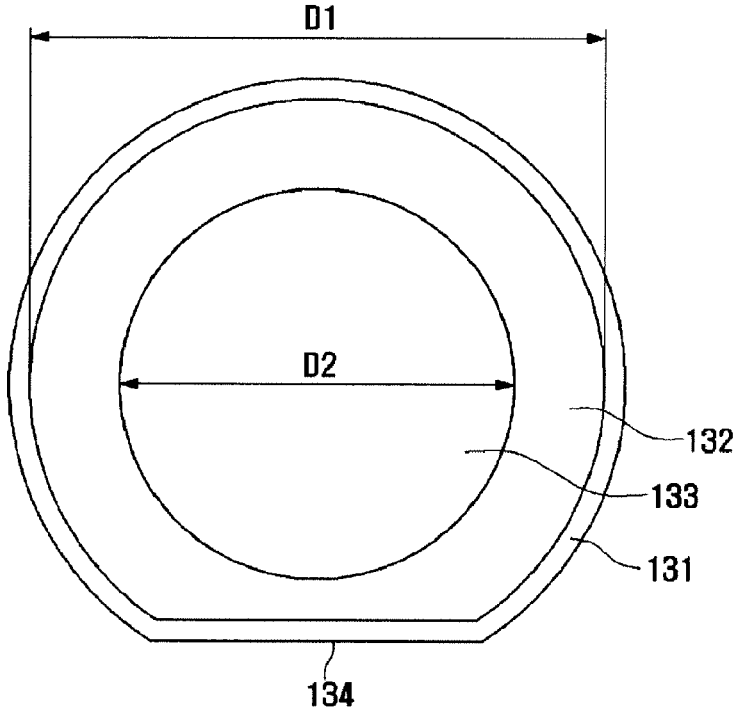
FIG. 10 is a bottom view of the gap member of FIG. 1.
Figure 11:
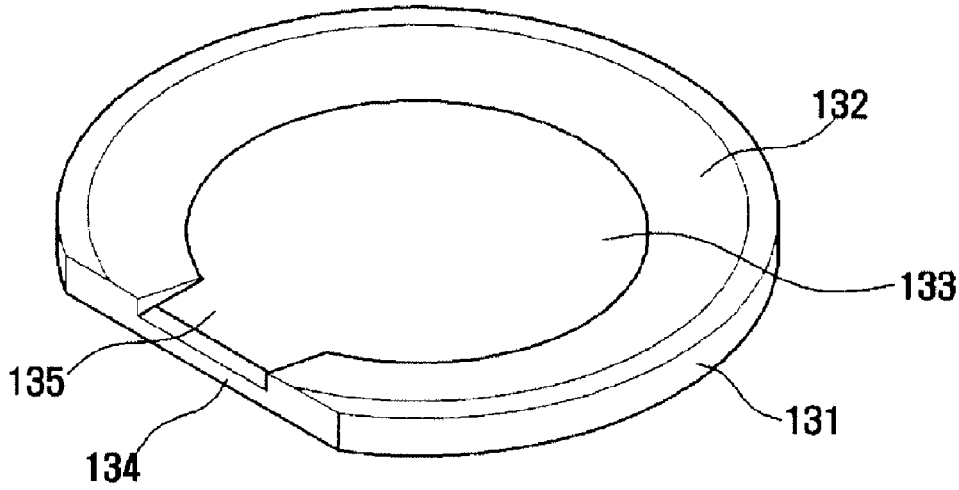
FIG. 11 is a perspective view of another example of the gap member of FIG. 1.
Figure 12:
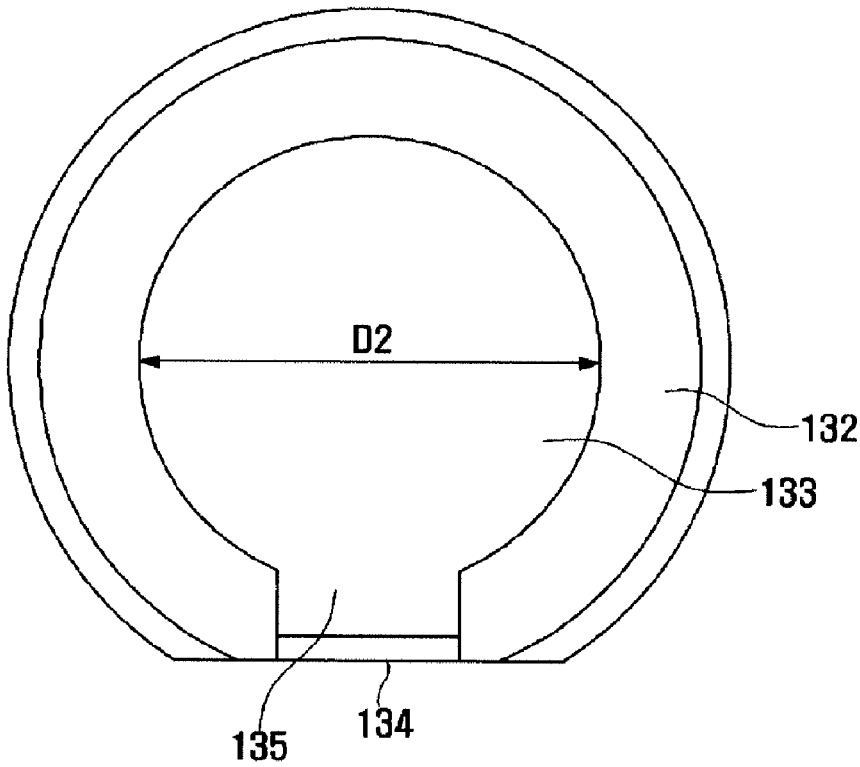
FIG. 12 is a plan view of another example of the gap member of FIG. 1.
Figure 13:
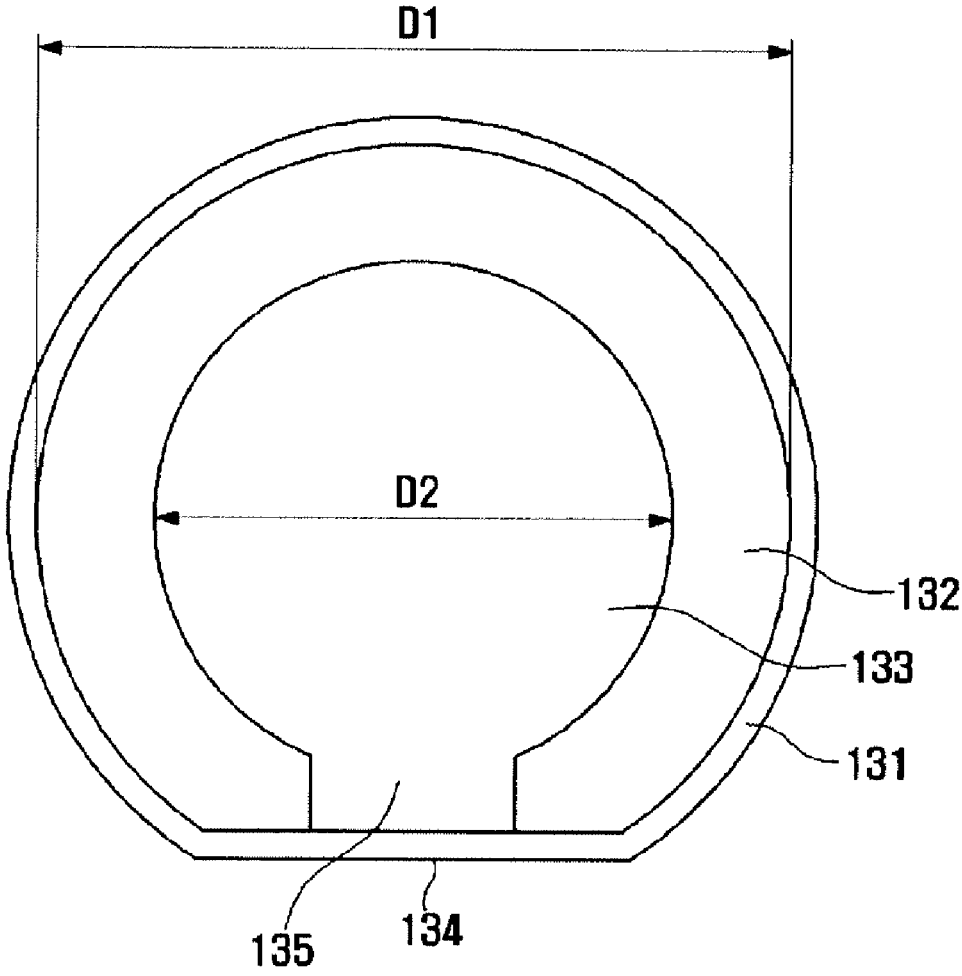
FIG. 13 is a bottom view of another example of the gap member of FIG. 1.

FIG. 7 is a side cross-sectional view a gap member 130 of FIG. 1, FIG. 8 is a perspective view of the gap member 130 of FIG. 1, FIG. 9 is a plan view of the gap member 130 of FIG. 1, FIG. 10 is a bottom view of the gap member 130 of FIG. 1, FIG. 11 is a perspective view of another example of the gap member 130 of FIG. 1, FIG. 12 is a plan view of another example of the gap member 130 of FIG. 1, and FIG. 13 is a bottom view of another example of the gap member 130 of FIG. 1.

Referring to FIG. 1 and FIGS. 7 to 13, the gap member 130 is preferably ring-shaped, and it has a ring-shaped reflective portion 132 that slopes away from the lens 140 as the reflective portion 132 extends toward the center and a circular wall 131 extending downward away from the lens 140, where the circular wall 131 is coaxial with the reflective portion 132. Further, the gap member 130 has an opening formed there through, where the diameter of the opening is equal to the inner diameter of the reflective portion 132.

The reflective portion 132 is configured to increase light efficiency of a lighting device by allowing the light emitted from the LEDs to be reflected upward from the reflective portion 132.

The bottom of the reflective portion 132 is in contact with the upper surface of the light emitting unit 101 and the inner circumference of the wall 131 is in contact with the outer circumference of the light emitting unit 101, such that the light emitting unit 101 is seated in the gap member 130. In order to prevent the light emitting unit 101 from separating from the gap member 130, it is preferable that the inner diameter of the reflective portion 132 is smaller than the inner diameter of the wall 131 and the outer diameter of the light emitting unit 101.

Further, the configuration of the gap member 130 provides a space between the substrate 110 and the lens 140 as represented by gap G1, as shown, for example, in FIG. 1. Because the gap G1 is greater than or equal to the thickness of the LEDs 120 arranged on the substrate 110, the lens 140 does not press up against the LEDs 120. Further, gap G1 makes it possible to achieve a light emitting angle and light distribution.

Further, the gap member 130 prevents contact between other members, such as the case of a lighting device, and other surfaces, except for the bottom of the light emitting unit 101, and when the gap member 130 is made of an insulating material, the gap member 130 and the light emitting unit 101 are insulated. In addition, it is possible to prevent problems, such as electric short, EMI, and EMS, in the light emitting unit 101 and improve withstand voltage, by attaching a heat-proof pad or a heat-proof plate made of an insulating material to the bottom of the light emitting unit 101.

The space 105 may be filled with silicon or silicon resin. The LEDs 120 of the light emitting unit 101 are exposed through the opening 133 and a flange 144 of the lens 140 is disposed on the upper surface of the gap member 130.

A flat portion 134 may be formed at a predetermined portion of the substrate 130, in which the flat portion 134 indicates the joint between components or prevents rotation therebetween. To be more specific, embodiments are assumed, such as the substrate 110 of the light emitting unit 101 shown in FIGS. 3 to 6 in which the flat portion 114 is formed at a predetermined portion of the substrate 110, and such as the gap member 130 shown in FIGS. 8 to 13 in which the flat portion 134 is formed in the gap member 130. Referring to FIGS. 10 to 13, since not only the outer side, but the inner side of the flat portion 134 of the gap member 130 is flat, the substrate 110 is fitted in the gap member 130, with the two flat portions 114 and 134 in contact with each other. Since predetermined portions of the inner circumference of the wall 131 and the outer circumference of the substrate 110 are flat, they are not rotated or moved from the positions.

The reflective portion 132 extends at a predetermined inclination from the upper surface of the wall 131 toward the center of the opening 133. That is, the reflective portion 132 is declined at a predetermined angle θ1 from the outer edge of the opening 133 of the gap member 130. A prism surface 142 of the lens 140 is disposed at a distance above the inclined surface of the reflective portion 132, such that the amount of reflected light an be changed in accordance with the width off the inclination angle θ1 and the width of the reflective portion 132. The opening 133 inside the reflective portion 132, as shown in FIGS. 8 to 10, may be formed in a circle having a predetermined diameter D2.

The light reaching the reflective portion 132, in the light emitted from the LEDs 120, are reflected from the reflecting portion 132 and travels outside through the lens 140. Therefore, additional effect of improving light efficiency is achieved as compared with common gap members without the reflective portion 132. It was described already that the gap member 130 according to this embodiment improves withstand voltage as compared with common gap members.

As shown in FIGS. 11 to 13, and 17, the gap member 130 may have an electric wire (not shown) connected to the substrate 110 or an electrode-through portion 135 through which the lead electrode 170 passes.

In FIGS. 8 to 13, only the gap member 130 having the flat portion 134 is shown and the gap member 130 having the flat portion 134 is a preferred embodiment. However, the gap member 130 having an entirely circular shape without the flat portion 134 may rotate or move from the position between the parts, but except for this defect, it has all the effects of improvement of light efficiency and withstand voltage, which the gap member 130 of the embodiments described above has, and accordingly, it should be understood that not the gap member 130 having the flat portion 134 was limitatively described, but optimal embodiments were described.

Before describing the shape and structure of the lens 140, the lens 140 proposed in the embodiments relating to the present invention is the lens 140 used for lighting unit 100 that is usually mounted in exterior lights, such as street lamps and outdoor lamps; therefore, it needs to see first what the efficient luminance distribution is in the lens 140.

<Efficient Luminance Distribution>

Figure 14:
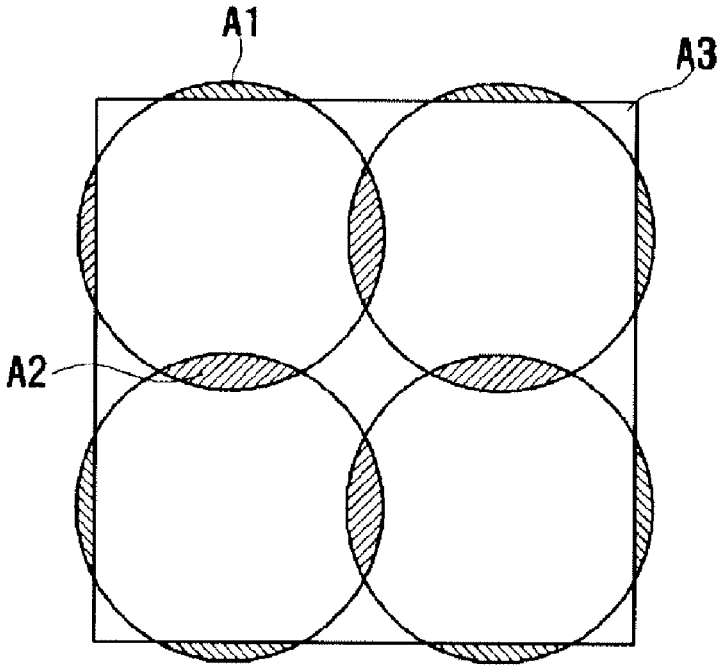
FIG. 14 is a view showing a radiation surface when luminance distribution makes a circle.
Figure 15:
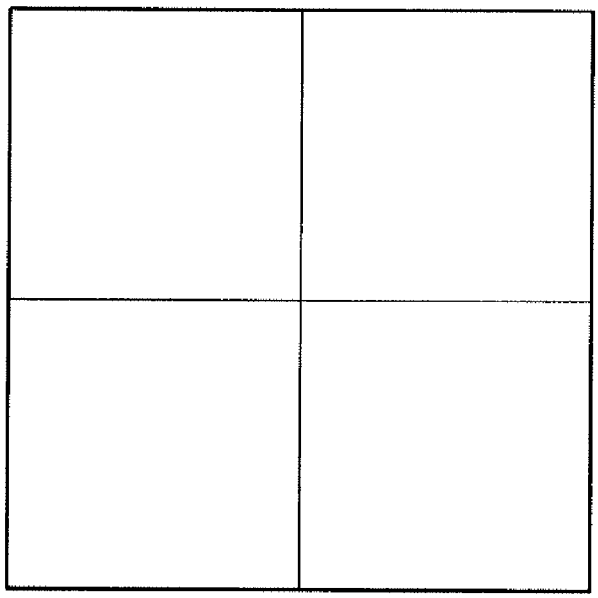
FIG. 15 is a view showing a radiation surface when luminance distribution makes a square.

FIG. 14 is a view showing a radiation surface when luminance distribution makes a circle and FIG. 15 is a view showing a radiation surface when luminance distribution makes a square.

Referring to FIGS. 14 and 15, it can be seen that efficiency is high when the light emitted from the lighting unit 100 makes rectangular luminance distribution as compared when it is a circle, by reducing waste of light A2 due to overlap of light and dead angel areas A3, and also reducing light A1 radiated to regions that do not need to be illuminated.

Compare a street lamp and an external lamp using the lighting unit 100 having the circular luminance distribution with a street lamp and an external lamp using the lighting unit 100 having the square luminance distribution. The latter can improve luminance distribution between adjacent street lamps or adjacent outdoor lamps and reduce or remove the dead angle areas A3 in comparison with the former, such that it is possible to make the distance between the street lamps or the outdoor lamps larger in the latter than the former. Further, since it is possible to reduce the number of necessary street lamps or outdoor lamps to achieve desire luminance, the maintenance and operational cost can be saved.

Although an example of the square luminance distribution in quadrilaterals was shown in FIG. 15, it is advantageous to make rectangular luminance distribution, not the square, in order to illuminate a narrow and long region, such as the street lamps illuminating roads and the outdoor lamps. Therefore, any one of the rectangular luminance distribution and the square luminance distribution may be advantageous relatively to the other, depending on the usage of the lighting unit 100.

The structure of the lens 140 for achieving rectangular luminance distribution will be gradually described hereafter.

<Structure of Lens for Achieving Asymmetric Luminance Distribution-Incident Surface Including Prism Surface>

Figure 16:
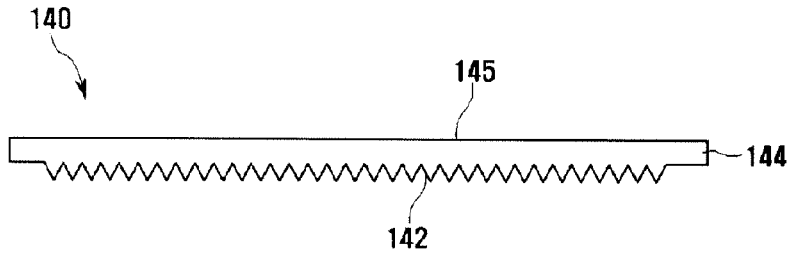
FIG. 16 is a side cross-sectional view of a lens with an incident surface of only a prism surface and a flat exit surface.
Figure 17:
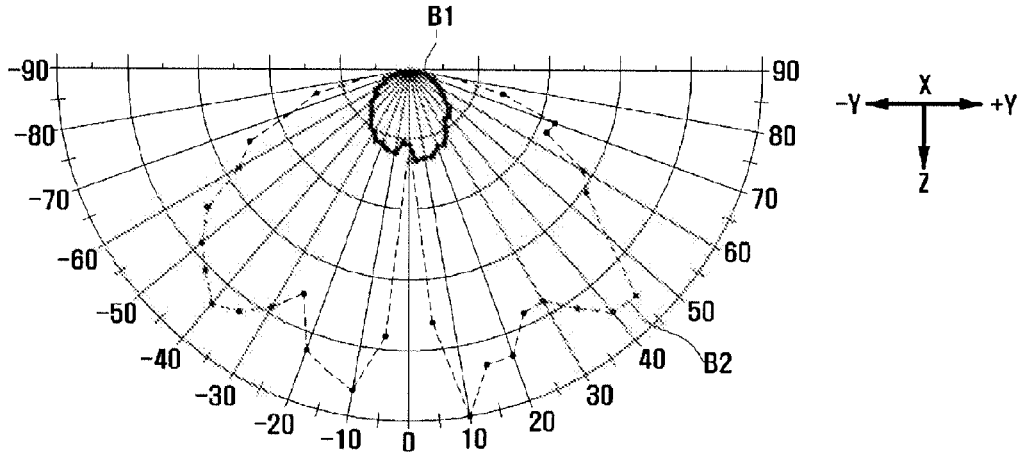
FIG. 17 is a view showing spatial light distribution by a lighting unit including the lens of FIG. 16.

FIG. 16 is a side cross-sectional view of a lens with an incident surface 143 of only a prism surface 142 and a flat exit surface 145 and FIG. 17 is a view showing spatial light distribution by the lighting unit 100 including the lens 140 of FIG. 16.

Referring to FIG. 17, light distribution when the lighting unit 100 is seen from the front in the X direction is shown as B2 and light distribution when the lighting unit 100 is seen from the front in the Y direction is shown as B1. The reason that B2 is wider than B1 is because light is diffused in the Y direction by the prism surface 142. Therefore, this asymmetric luminance distribution is a relatively approximate rectangle, rather than circular luminance distribution. However, because the prism surface 142 disperses the light to the outside, the center portion is shown relatively darker than other radiation surfaces, when the lighting unit is seen in the X direction (B2). Further, similarly, the light width is small and the center portion is relatively darker than other radiation surfaces, when seen in the Y direction (B1).

Accordingly, the luminance distribution is not uniform in the lens with the incident surface 142 of only the prism surface 142 and the flat exit surface 145. Further, when a plurality of lighting devices are used, there are unnecessarily many overlaps of light and many dark dead angle areas are made to reduce wasted portions due to overlap of light, such that it is still difficult to efficiently operate the lighting devices.

Therefore, it is described when the exit surface 145 is a spherical lens 140, as a structure of the lens 140 that can compensate diminished luminance at the center portion of the radiation surface.

<Structure of Lens Capable of Compensate Luminance Diminished at Center of Radiation Surface—Lens with Spherical Exit Surface>

Figure 18:
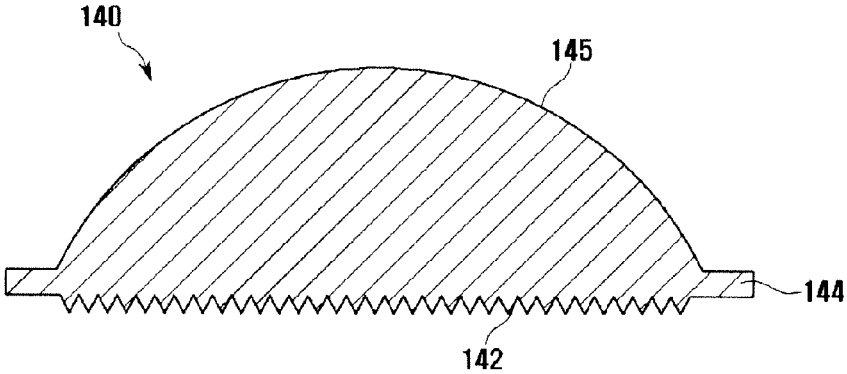
FIG. 18 is a side cross-sectional view of a lens with an incident surface of only a prism surface and a spherical exit surface.
Figure 19:
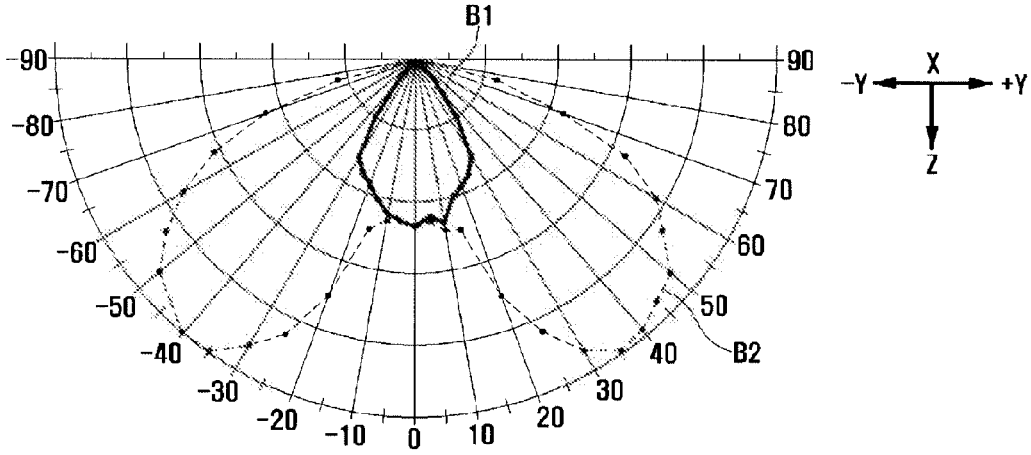
FIG. 19 is a view showing spatial light distribution by a lighting unit including the lens of FIG. 18.
Figure 20:
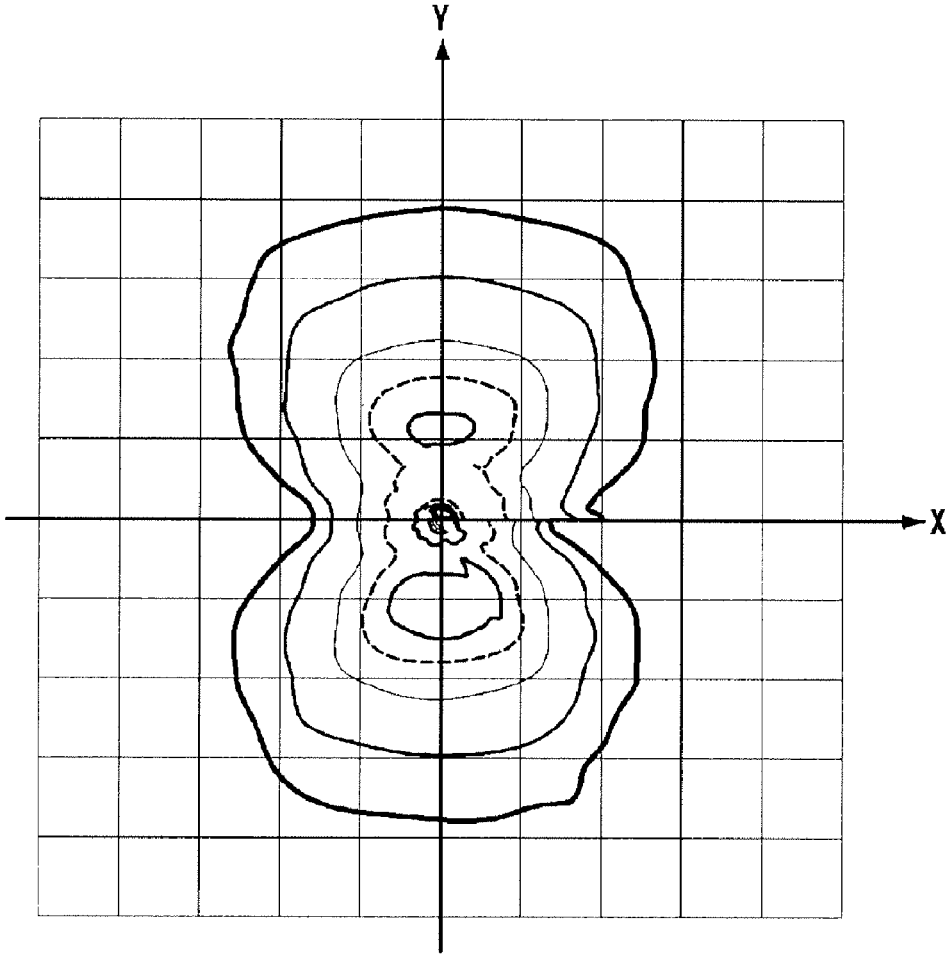
FIG. 20 is a view showing spatial light distribution by a lighting unit including the lens of FIG. 18.

FIG. 18 is a side cross-sectional view of a lens with an incident surface 143 of only a prism surface and a spherical exit surface 145, FIG. 19 is a view showing spatial light distribution by a lighting unit 100 including the lens 140 of FIG. 18, and FIG. 20 is a view showing spatial light distribution by a lighting unit 100 including the lens 140 of FIG. 18.

Comparing FIG. 17 with FIG. 19, it can be seen that light intensity was improved in comparison with the lens 140 with the flat exit surface 145, when seen from the Y-axis (B1) and the light intensity was significantly improved at the center portion when seen from the X-axis (B2). However, the light intensity is still small at the center portion, and referring to FIG. 20, the luminance distribution shows a shape of a dumbbell or butterfly in the radiation surface. As a result, since it is still impossible to achieve luminance distribution of an approximate rectangle with the lens 140 with the incident surface 143 of only the prism surface 142 and the spherical exit surface 145, it needs to additionally consider a lens 140 having a furrow surface on the incident surface 143.

<Lens with Incident Surface Having Furrow Surface>

Figure 21:
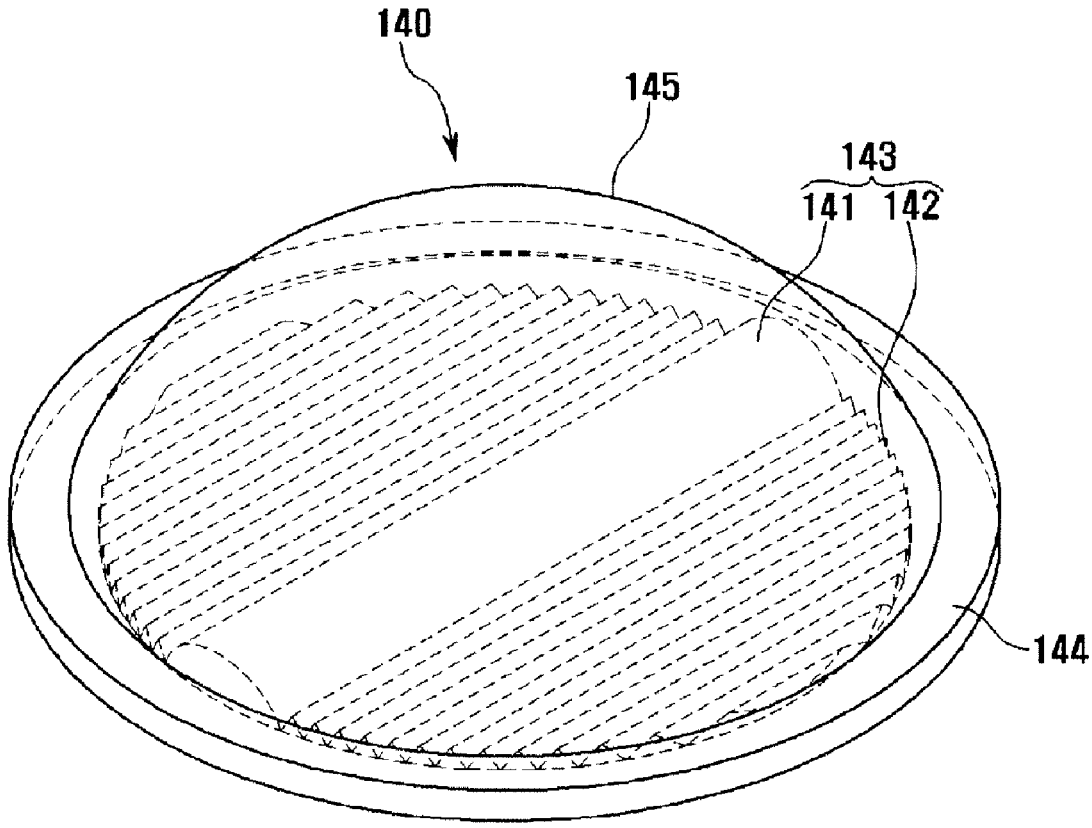
FIG. 21 is a perspective view of a lens with an incident surface of a prism surface and a furrow surface, and a spherical exit surface.
Figure 22:
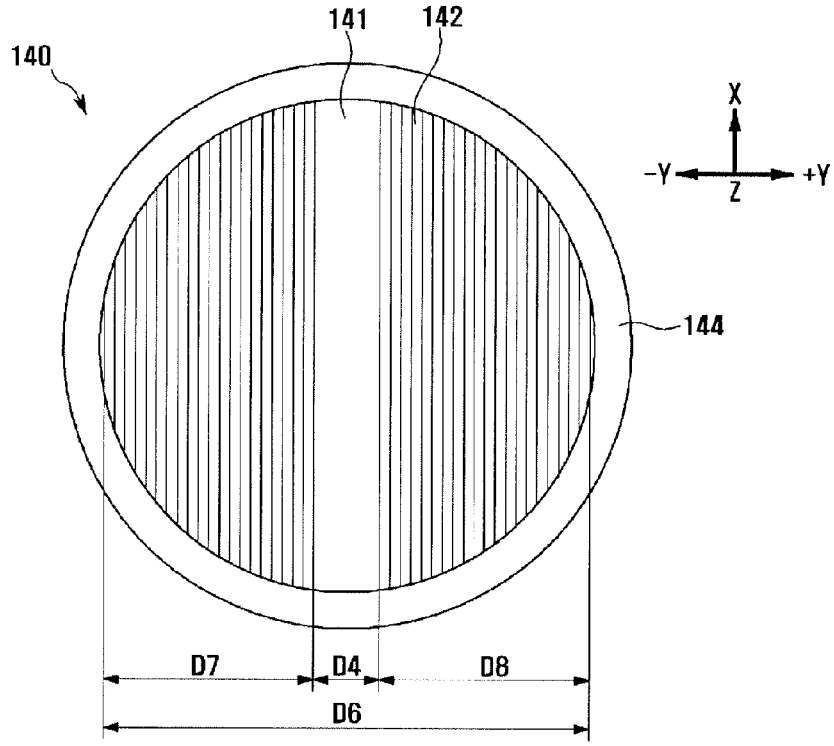
FIG. 22 is a plan view of a lens with an incident surface of a prism surface and a furrow surface, and a spherical exit surface.
Figure 23:
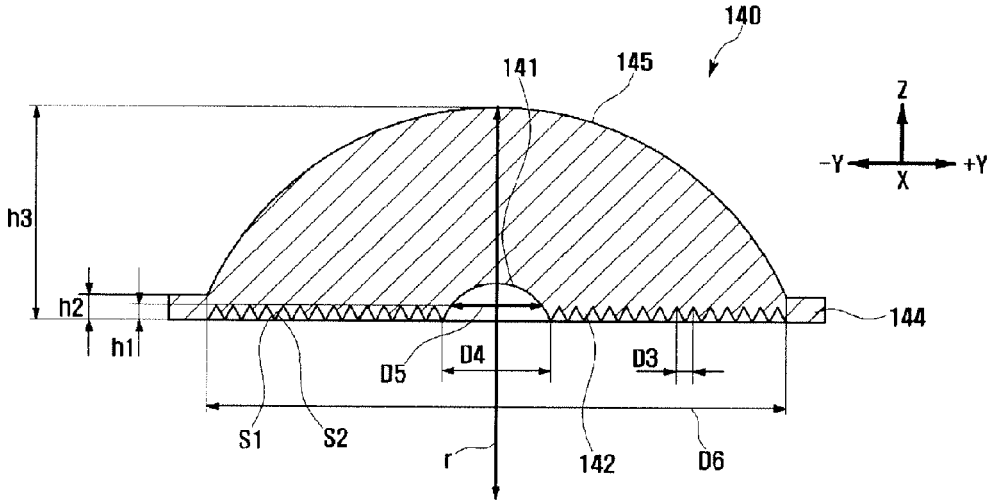
FIG. 23 is a side cross-sectional view of a lens with an incident surface of a prism surface and a furrow surface, and a spherical exit surface.
Figure 24:
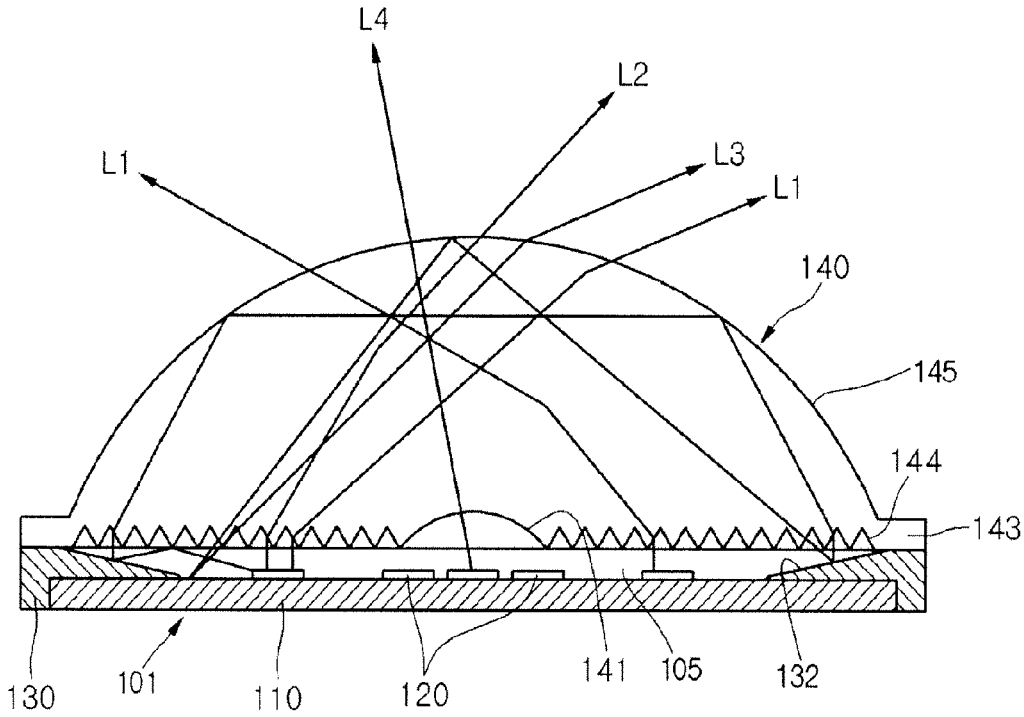
FIG. 24 is a view showing light paths of light emitted from LEDs of the lighting unit of FIG. 1.

The entire configuration of a lens 140 with an incident surface 143 having a furrow surface 141 and the configuration of a lighting unit 100 including the lens are described first. FIG. 21 is a perspective view of a lens 140 with an incident surface 143 comprising a prism surface 142 and a furrow surface 141, and a spherical exit surface 145. FIG. 22 is a plan view of a lens 140 with an incident surface 143 comprising the prism surface 142 and the furrow surface 141. In FIG. 22, the spherical exit surface 145 is not shown. FIG. 23 is a side cross-sectional view of a lens 140 with an incident surface 143 comprising the prism surface 142 and the furrow surface 141, and a spherical exit surface 145. FIG. 24 is a view showing light paths of light emitted from LEDs 120 of the lighting unit 100 of FIG. 1.

Referring to FIG. 1 and FIGS. 21 to 23, the lens 140 is disposed above the light emitting unit 101. The lens 140 has the incident surface 143 and the exit surface 145. The furrow surface 141 and the prism surface 142 form at least a portion of the incident surface 143. A circular flange 144 is formed around the incident surface 143 of the lens 140.

The lens 140 may be formed by injection-molding a light transmissive material, and the material may be glass and plastic, such as PMMA (Poly methyl methacrylate) and PC (Polycarbonate).

The incident surface 143 is perpendicular to the light axis, and the furrow surface 142 transverses the incident surface, preferably through the center of the incident surface 143, as shown most clearly in FIG. 22. Referring to FIGS. 1 and 22, it can be seen that the furrow surface 141 is formed in the X-axis direction perpendicular to the light axis Z. The furrow surface 141 may have an arc cross section when cut along a plane (YZ-plane) perpendicular to the longitudinal direction of the furrow surface 141. Alternatively, the cross-sectional shape of the furrow surface 141 may include a parabola, a hyperbola, or an ellipse. As a result, the furrow surface 141 has a round shape when seen from the incident surface 143, and in more detail, it has a depressed surface of a cut cylinder, when cut along a plane parallel with the longitudinal direction of the cylinder. Further, the width D4 of the furrow surface 141 may be 9%~40% of the diameter D6 of the incident surface.

The prism surfaces 142 are formed at both sides of the furrow surface 141. The prominences and depressions of the prism surface 142 extend in the axis X direction perpendicular to the light axis Z, in which the prominences and depressions are continuously arranged in the direction −Y, +Y which is perpendicular to the longitudinal direction X of the furrow surface 141 and the light axis Z. Preferably, the prominences and depressions have a triangular cross section, when they are cut along a plane YZ perpendicular to the longitudinal direction of the furrow surface 141 of the prism surface 142. Both sides S1 and S2 of the triangular prominences may be the same or different in length and angle.

Further, the gap between the prominences and depressions of the prism surfaces 142 may be constant or they may progressively become smaller from the inner portion to the outer portion along the −Y-axis and +Y-axis. This density depends on the light distribution.

The prism surface 142 is positioned between the furrow surface 141 and the flange 144. The prism surface 142 can increase the light distribution in the left-right direction −Y,+Y by being arranged in the side direction perpendicular to the longitudinal direction, for example in the left-right direction −Y,+Y.

The exit surface 145 can reflect or refract incident light to the outside. The exit surface 145 may be a non-spherical lens or a spherical lens and the shape of non-spherical lens or spherical lens can be selected in consideration of light distribution and luminance distribution.

Reflected light, which does not travel outside through the exit surface 145, travels through the exit surface 145 while the light emitting angle changes through at least one of the prism surface 142, the reflective unit 132, and the upper surface of the substrate 110.

Referring to FIG. 24, in the light L1, L2, and L3 emitted from the outermost LEDs 120 of the light emitting unit 110, the light L1 and L2 travel outside through the prism surface 142 and the exit surface 145, while the light L3 is reflected and travels outside through the exit surface 145, with the critical light angle changed sequentially through the reflective unit 132, the prism surface, the exit surface 145, and the prism surface 142.

The light L4 emitted from the LED 120 at the center of the light emitting unit 110 is refracted and diffused through the furrow surface 141 of the lens 140 and travels outside through the exit surface 145.

The structures of the lens 140 with an incident surface 143 having a furrow surface 141 and the lighting unit 100 including the lens 100 was seen above, and spatial light distribution and luminance distribution are described hereafter.

Figure 25:
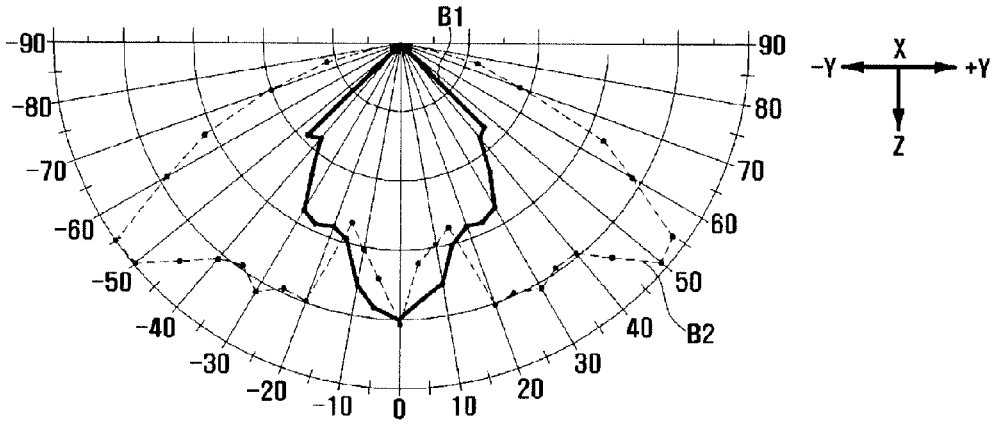
FIG. 25 is a view showing spatial light distribution by a lighting unit using the lens of FIG. 21.
Figure 26:
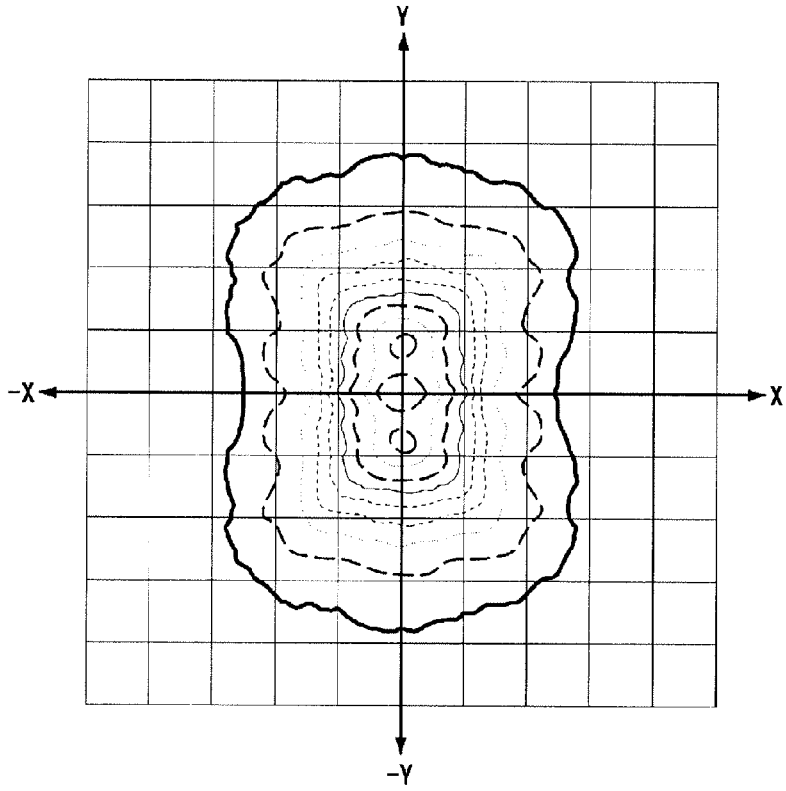
FIG. 26 is a view showing spatial light distribution by a lighting unit using the lens of FIG. 21.

FIG. 25 is a view showing spatial light distribution by a lighting unit 100 using the lens 140 of FIG. 21 and FIG. 26 is a view showing spatial light distribution by a lighting unit 100 using the lens 140 of FIG. 21. Referring to FIG. 25, light distribution when the lighting unit 100 is seen from the front in the X direction is shown as B2 and light distribution when the lighting unit 100 is seen from the front in the Y direction is shown as B1. The reason that B2 is wider than B1 is because light is diffused in the Y direction by the prism surface 142. Unlike FIG. 19, however, since the lens 140 has the furrow surface 141, it can be seen that spatial light distribution was improved, when seen from the X-axis and the Y-axis. That is, the light distribution is considerably large around the light axis Z, as compared with FIG. 19. Further, when seen from the Y-axis direction (B1), light width is large and more light are radiated to the radiation surface in comparison with FIG. 19, and when seen from the X-axis direction (B2), relatively darker regions than other radiation surface are significantly reduced around the X-axis, as compared with FIG. 19.

Referring to FIG. 26, the radiation region where light is radiated has an approximate rectangular shape, when the light is radiated through the lens 140. This shape has a remarkable difference from the dumbbell or ribbon shape of FIG. 20. Similar to FIG. 17, it is an effect of the prism surface 142 that the light is diffused in the Y-axis direction and it is an effect of the furrow surface 141 that light is radiated without making the region around the X-axis dark. As compared with the lens 140 shown in FIG. 18, the furrow surface 141 additionally provided to the lens of FIG. 21 functions as a luminance reinforcement surface that compensate the luminance in the center region of the radiation surface.

When the exit surface 145 is a spherical lens or a non-spherical lens is described in detail with reference to FIG. 23. In this configuration, h1 is the thickness of the prism surface, h2 is the thickness of the flange 144, h3 is the thickness of the lens 140, D3 is the gap between adjacent prism, D4 is the width of the furrow surface 141, D6 is the width of the lens 140 except for the flange 144, r is the radius of curvature of the exit surface 145, S1 is one side in the cross section of the prism surface 142, and S2 is the other side in the cross section of the prism surface 142. A formula representing the spherical lens-shaped exit surface 145 is as <Formula 1>.

$$z = \frac{\frac{1}{r}\left(\frac{D6}{2}\right)^2}{1+\sqrt{1-\left(\frac{1}{r}\right)^2\left(\frac{D6}{2}\right)^2}} \quad \text{[Formula 1]}$$

In <Formula 1>, the relationship of $$\left(\frac{D6}{2}\right)^2 = x^2 + y^2$$

is satisfied, z is the height from the incident surface 143 to the exit surface 145, D6 is the width of the lens 140 except for the flange 144, and r is the radius of curvature of the exit surface 145.

A formula representing the conical lens-shaped exit surface 145 is as <Formula 2>.

$$z = \frac{\frac{1}{r}\left(\frac{D6}{2}\right)^2}{1+\sqrt{1-(1+k)\left(\frac{1}{r}\right)^2\left(\frac{D6}{2}\right)^2}} \quad \text{[Formula 2]}$$

In <Formula 1>, the relationship of $$\left(\frac{D6}{2}\right)^2 = x^2 + y^2$$

is satisfied, z is the height from the incident surface 143 to the exit surface 145, D6 is the width of the lens 140 except for the flange 144, r is the radius of curvature of the exit surface 145, and k is a conic constant.

A formula representing the non-spherical lens-shaped exit surface 145 is as <Formula 3>

$$z = \frac{\frac{1}{r}\left(\frac{D6}{2}\right)^2}{1+\sqrt{1-(1+k)\left(\frac{1}{r}\right)^2\left(\frac{D6}{2}\right)^2}} + \sum_{n=2}^{10} C_{2n}\left(\frac{D6}{2}\right)^{2n} \quad \text{[Formula 3]}$$

The symbols in <Formula 3> are the same as those in <Formula 2>, and $C_{2n}$ is a non-spherical surface constant.

Any spherical surface of non-spherical surface may be used for the shape of the exit surface 145, as long as they satisfy <Formula 1>, <Formula 2>, and <Formula 3>, In particular, the shape depends on the conic constant k in <Formula 2>, that is, it becomes a sphere at K=0, an ellipse at $-1<k<0$, a parabola at K=1, a hyperbola at $k<-1$, and an oblate spheroid at $k>0$.

Since there are a lot of cases when the exit surface 145 satisfies the formulae and efficiency of the lighting unit 100 is seen for each case, by way of several representative examples. Simulation data acquired by executing a computer program, FTE Calculator, in order to see the efficiency of the lighting unit 100 and the object of the simulation using the computer program is to acquire certification from Energy Star and inspect the efficiency of the lighting unit 100 at the same time. Accordingly, certification from Energy Star and simulation data are examined hereafter.

<Certification from Energy Star and Examination of Light efficiency of Radiation Surface>

Energy Star is an international program about energy efficiency in the United States and also a common program of DOE and EPA of the United States, and gives a mark "ENERGY STAR" to product satisfying a guide line in energy efficiency. Many consumers prefer to products acquired the mark from Energy Star in the Unite States and the merits of the product acquiring the mark from Energy Star are different in the state governments, such that acquiring certification from Energy Star largely helps improve commercial value of products.

Certification from Energy Star means that lighting devices can illuminate a desired region to illuminate with less power at predetermined luminance and the number of necessary lighting device can be reduced, such that they can be considered as high-efficiency lighting devices.

In the embodiments proposed in connection with the present invention, the proposed lenses 140 are the lenses 140 that is used the lighting units 100 generally mounted in external lamps, such as street lamps and outdoor lamps; therefore, they have to satisfy Outdoor Area & Parking Garage of Category A in the standard of Energy Star. The computer program, FTE Calculator, is used to check whether the standard is satisfied and it is clear that those skilled in the art can easily obtain the computer program.

Figure 27:
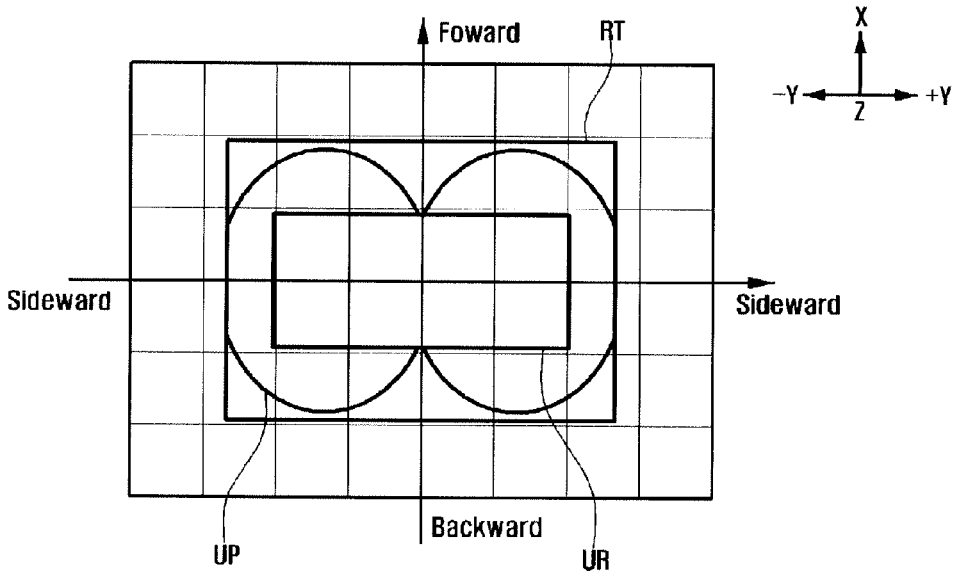
FIG. 27 is a view showing luminance distribution of a radiation surface according to an FTE Calculator.

FIG. 27 is a view showing lamination distribution of a radiation surface according to an FTE calculator.

Referring to FIG. 27, RT is Rectangular Target, UP is Uniform Pool, UR is Uniform Rectangle, Sideward is luminance distribution in +Y,−Y direction, Forward is luminance distribution in +X direction, and Backward is luminance distribution in −X direction. The simulation data to observe was based on luminance distribution of the radiation surface when all of the light sources were at a height of 10 m, and in FIG. 27, the width of the lattices is 10 m in both length and breadth. For example, when the Sideward is 2.5, it means the luminance distribution is a space within 25 m in the +Y direction and 25 m in the −Y direction. The simulation data was based on Unshielded in Outdoor Area & Parking Garage of Category A in Energy Star Standard, under assumption that the lighting device has luminaire output of around 9000 lm; therefore, in this case the FTE value (lm/W) for satisfying Energy Star should be 53. Input power of 120 W was measured. In the embodiments, the larger the Uniform Rectangle UR, the ratio occupied by the Uniform Pool UP in the Rectangular Target RT (hereafter referred to as 'Covered'), and the width of the Sideward in both Rectangular Target RT and Uniform Rectangular UR, the more the lighting device is efficient. Hereafter, the Covered is described in detail. For example, assume that the maximum luminance value is 30 in the radiation region where light emitted from the lighting is radiated and the minimum luminance value is 1. The values 30 and 1 are not absolute values, but ratios of two values. Further, a region S1 where the luminance value is in the range of 1 to 30 is specified. Further, a region where the luminance value is 1 is excepted, when the average luminance value in the specified region S1 is more than 6, which is six times the minimum luminance value.

When the minimum luminance value is 1.1 after the region where the luminance value is 1 is excepted, the radiation region is a region S2 where the luminance value is in the range of 1.1 to 30. When it is determined that the average luminance value in S2 is less than 6.6, which is six times the minimum luminance value 1.1, S2 is specified as the Uniform Pool (UP). If it is more than 6.6, the above process is repeated until the average luminance value does not excess six times the minimum luminance value, and Sn is specified as the Uniform Pool (UP). A rectangle surrounding Sn specified as described above is Rectangular Target T. Consequently, Covered represents (UP/RT)*100.

Although the simulation data was measured on the basis of the premise and values, required FTE value, Covered, and efficient shape may be changed in accordance with the usage, installed height, input voltage, and output intensity of light of the lighting device. For example, the values used in the simulation is examples and may be measured on the basis of the Unshielded type in the FTE Calculator, and accordingly, the required FTE value may changes, such as 37, 48, and 70.

h1 was 1 mm, h3 was 14.6 mm, and D6 was 45 mm in all of the experiments, but r was 24.64 mm when the exit surface 145 was a spherical lens and r was 17 mm when the exit surface was a non-spherical lens. A conic constant for a hyperbola was sued when the exit surface 145 was a non-spherical surface, and only $C_4$,$C_6$, and $C_8$, the non-spherical constants, were used, which is substantially meaningful to define the shape of the lens 140. In this case, the experiment was performed with $C_4$ of $-9.7407\ e^{-8}$, $C_6$ of $4.1275\ e^{-8}$, and $C_8$ of $-4.1969\ e^{-12}$.

surface 141 of 4 mm, in which Covered was 85%, FTE (lm/W) was 58, Forward and Backward of FTE (Rectangular Target) were 1.7, Sideward was 2.5, Forward and Backward of FTE (Uniform Target) was 1.3, and Sideward was 2.1.

In the experimental example 5, the exit surface 145 was a non-spherical lens shape with the radius of curvature of the furrow surface 141 of 5 mm and the width of the furrow surface 141 of 8 mm, in which Covered was 88%, FTE (lm/W) was 60, Forward and Backward of FTE (Rectangular Target) were 1.6, Sideward was 2.5, Forward and Backward of FTE (Uniform Target) was 1.3, and Sideward was 2.1.

In the experimental example 6, the exit surface 145 was a non-spherical lens shape with the radius of curvature of the furrow surface 141 of 9.2 mm and the width of the furrow surface 141 of 12 mm, in which Covered was 83%, FTE (lm/W) was 57, Forward and Backward of FTE (Rectangular Target) were 1.6, Sideward was 2.4, Forward and Backward of FTE (Uniform Target) was 1.2, and Sideward was 2.0.

In the experimental example 7, the exit surface 145 was a non-spherical lens shape with the radius of curvature of the furrow surface 141 of 12 mm and the width of the furrow surface 141 of 16 mm, in which Covered was 89%, FTE (lm/W) was 61, Forward and Backward of FTE (Rectangular Target) were 1.4, Sideward was 2.1, Forward and Backward of FTE (Uniform Target) was 1.2, and Sideward was 1.7.

The exemplary embodiments are as the following Table 1.

TABLE 1

| | Radius of curvature/ width of furrow surface | Shape of exit | Minimum widthn X-axis direction at maximum luminance | Maximum widthn Y-axis direction at maximum luminance | FTE(Rectangular Target) | | | | FTE(Uniform) Rectangle) | | |
|---|---|---|---|---|---|---|---|---|---|---|---|
| | (mm) | surface | 10% | 10% | Forward | Sideward | Backward | Covered(%) | Forward | Sideward | Backward |
| 1 | no | Spherical surface | 10 | 22 | 1.9 | 2.6 | 1.9 | 76 | 0.9 | 2.0 | 0.9 |
| 2 | 5/8 | Spherical surface | 11 | 22 | 1.7 | 2.6 | 1.7 | 84 | 1.3 | 2.1 | 1.3 |
| 3 | no | Non-spherical surface | 10 | 23 | 1.8 | 2.5 | 1.8 | 81 | 0.9 | 2.0 | 0.9 |
| 4 | 2/4 | Non-spherical surface | 12 | 23 | 1.7 | 2.5 | 1.7 | 85 | 1.3 | 2.1 | 1.3 |
| 5 | 5/8 | Non-spherical surface | 12 | 23 | 1.6 | 2.5 | 1.6 | 88 | 1.3 | 2.1 | 1.3 |
| 6 | 9.2/12 | Non-spherical surface | 14 | 23 | 1.6 | 2.4 | 1.6 | 83 | 1.2 | 2.0 | 1.2 |
| 7 | 12/16 | Non-spherical surface | 15 | 20 | 1.4 | 2.1 | 1.4 | 89 | 1.2 | 1.7 | 1.2 |

In the experimental example 1, the exit surface 145 was a spherical lens shape without the furrow surface 141, in which Covered was 76%, FTE (lm/W) was 53, Forward and Backward of FTE (Rectangular Target) were 1.9, Sideward was 2.6, Forward and Backward of FTE (Uniform Target) was 0.9, and Sideward was 2.0.

In the experimental example 2, the exit surface 145 was a spherical lens shape with the radius of curvature of the furrow surface 141 of 5 mm and the width of the furrow surface 141 of 8 mm, in which Covered was 84%, FTE (lm/W) was 58, Forward and Backward of FTE (Rectangular Target) were 1.7, Sideward was 2.6, Forward and Backward of FTE (Uniform Target) was 1.3, and Sideward was 2.1.

In the experimental example 3, the exit surface 145 was a non-spherical lens shape without the furrow surface 141, in which Covered was 81%, FTE (lm/W) was 55, Forward and Backward of FTE (Rectangular Target) were 1.8, Sideward was 2.5, Forward and Backward of FTE (Uniform Target) were 0.9, and Sideward was 2.0.

Figure 28:
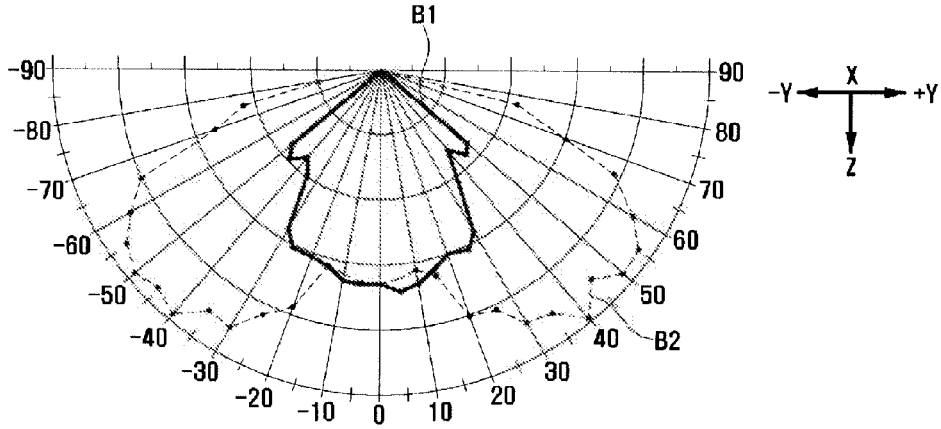
FIG. 28 is a view showing spatial light distribution by a lighting unit using a lens of en experimental example 5.
Figure 29:
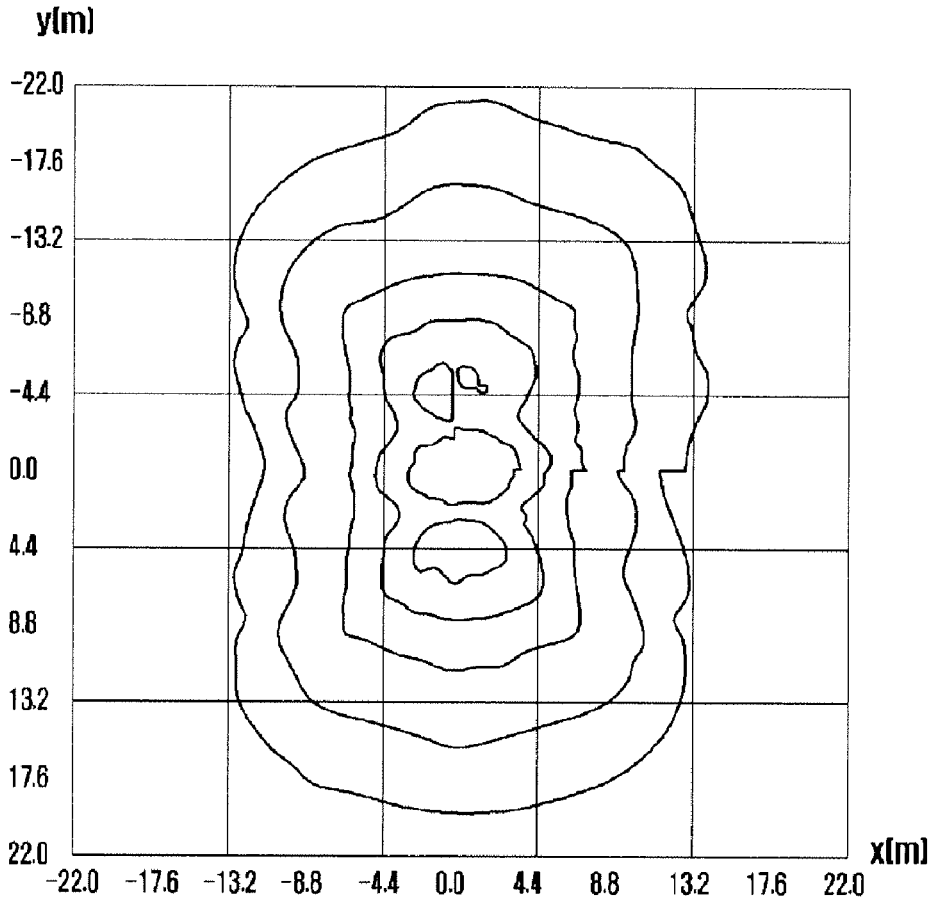
FIG. 29 is a view showing spatial light distribution by a lighting unit using the lens of the experimental example 5.

In the experimental example 4, the exit surface 145 was a non-spherical lens shape with the radius of curvature of the furrow surface 141 of 2 mm and the width of the furrow FIG. 28 is a view showing light distribution in a space by a lighting unit 100 using the lens 140 of the experimental example 5 and FIG. 29 is a view showing light distribution in a space by a lighting unit 100 using the lens 140 of the experimental example 5. Referring to FIG. 28, light distribution when the lighting unit 100 is seen from the front in the X direction is shown as B2 and light distribution when the lighting unit 100 is seen from the front in the Y direction is shown as B1. Referring to FIG. 29, it can be seen that the luminance distribution in the Y-axis direction is considerably wider than the luminance distribution in the X-axis direction and an approximate rectangle. Comparing FIG. 28 with FIG. 25, it can be seen that the center portion of the radiation surface is lack of light and not dark in both FIG. 28 and FIG. 25, but there is excessive light at the center portion relatively to the interface region of light, such that light is not uniformly distributed over the entire radiation surface in FIG. 25. On the other hand, it can be seen that light is less at the center portion of FIG. 28 than FIG. 25, such that luminance distribution is uniform over the entire radiation surface.

Considering the data of FIG. 28, FIG. 29, and the experimental example seen above, the experimental example is the most efficient in the above experimental examples. In the experimental example 5, Sideward of FTE (Rectangular Target) is 2.5, Sideward of FTE (Uniform Target) is 2.1, which is a high level in the experimental example, Covered is 88%, which is the highest level, and FTE (lm/W) is 60 which is highest level. Therefore, it will be preferable to use the lens 140 having the values of the experimental example 5.

However, the factors for evaluating the efficiency of the lens 140 are various, such as the width of Sideward, Covered, FTE (lm/W) value, as described above, and the experimental example 5 is not absolutely excellent in all of the factors. Therefore, any one of the width of Sideward, Covered, FTE (lm/W) value may be important in real use of a lighting device, in which the lens of the other experimental examples than the experimental example 5 or the lenses 140 other than those of the experimental example 2 and the experimental example 4 to the experimental example 7 may show more excellent efficiency. However, in the lighting device 100 used for street lamps and outdoor lamps in external lamps, it is clear that the lighting unit 100 equipped with the lens 140, in which the exit surface 145 has a spherical or a non-spherical, the incident surface 143 has the prism surface 142 and the furrow surface 141, and the width of the furrow surface 141 is 9%~40% of the diameter of the incident side, has higher efficiency than common lighting devices, and the lenses 140 having these features should be considered as being included in the spirit of the present invention. Further, the lighting device 100 that preferably shows luminance distribution of an approximate rectangle for other usage than the street lamps and the outdoor lamps may also be equipped with the lenses 140 of the experimental examples and other equivalent lenses 140.

<Embodiment of Lighting Unit Using Lens Having Spherical or Non-Spherical Exit Surface and Incident Surface with Furrow Surface and Prism Surface>

Figure 30:
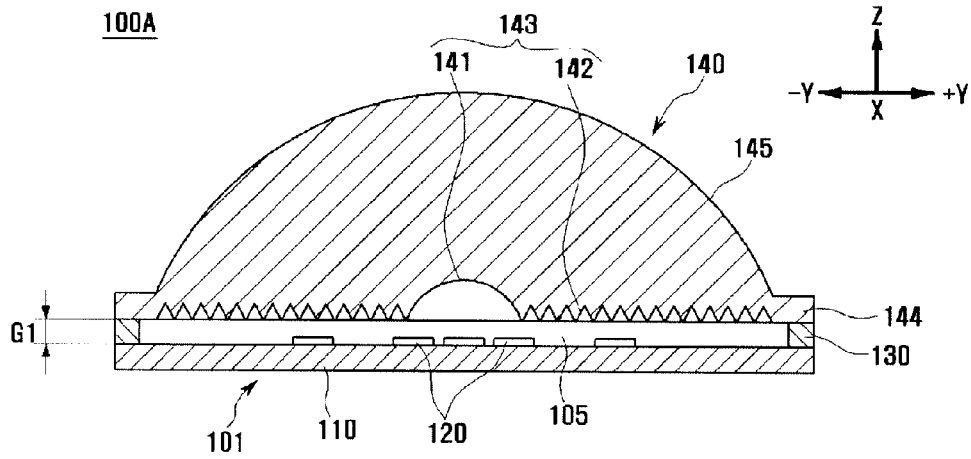
FIG. 30 is a side cross-sectional view showing a lighting unit according to a second embodiment.

FIG. 30 is a side cross-sectional view showing a lighting unit 100A according to a second embodiment. In the description of the second embodiment, the first embodiment is referred for the same components as those in the first embodiment and the repeated description is omitted.

Referring to FIG. 30, a lighting unit 100A includes a light emitting unit 101, a lens 140, and a gap member 130. The gap member 130 may be made of epoxy or silicon resin in a ring shape, and is in contact with the edge of the upper surface of the substrate 110 of the light emitting unit 101 and the bottom of the flange 144 of the lens 140. Therefore, it is disposed between the substrate 110 and the lens 140 to space the substrate 110 and the lens 140 by a predetermined gap G1. The space3 105 defined by the gap member 130 can improve light directional distribution of the LEDs 120 of the light emitting unit 101.

Meanwhile, fluorescent substances may be added to the gap member, if needed. Further, the upper surface of the substrate 110 of the light emitting unit 101 may be coated with a reflective substance to reflect light traveling to the substrate 110.

FIG. 31 is a side cross-sectional view showing a lighting unit 100B according to a third embodiment. In the description of the third embodiment, the first embodiment is referred for the same components as those in the first embodiment and the repeated description is omitted.

Referring to FIG. 31, in the lighting unit 100B, the flange 144A, which protrudes downward to the light emitting unit 101, of the lens 140 replaces the gap member 130. The flange 144A of the lens 140 can be disposed to contact the edge of the upper surface of the substrate 110 of the light emitting unit 101, or to contact both the outer circumference of the substrate 110 and the edge of the upper surface of the substrate 110 of the light emitting unit 101.

The flange 144A of the lens 140 spaces the substrate 110 of the light emitting unit 101 and the lens 140 by a predetermined gap G1.

The space 105 between the light emitting unit 101 and the lens 140 may be filled with resin, such as silicon or epoxy, and fluorescent substances may be added to the resin.

The substrate 110 of the light emitting unit 101 is disposed under the flange 144A of the lens 140 and the lens flange 144*a* is stepped with respect to the incident surface 143. According to another example, a protrusion may be formed around the outer circumference of the upper surface of the substrate to maintain the gap between the substrate 110 and the lens 140.

Figure 32:
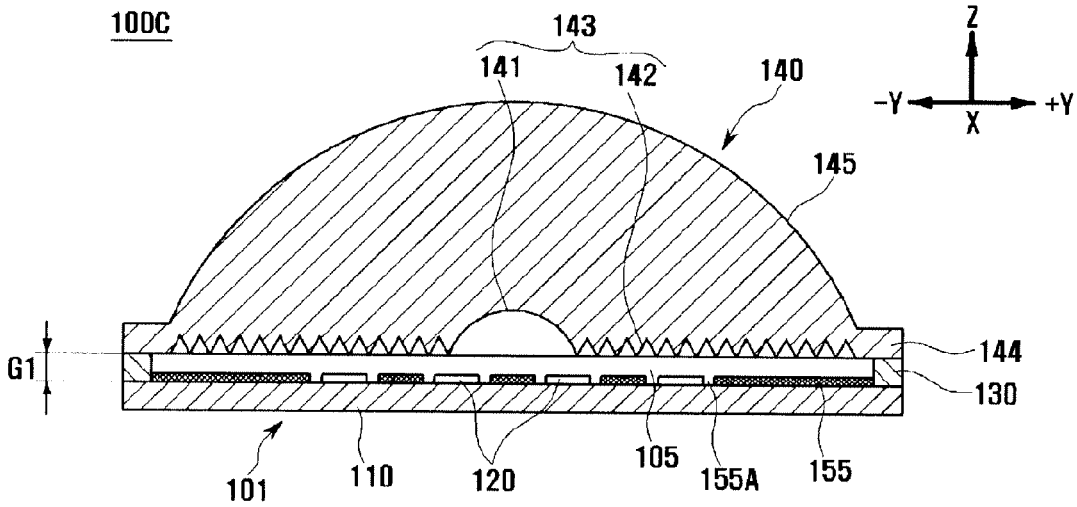
FIG. 32 is a side cross-sectional view showing a lighting unit according to a fourth embodiment.

FIG. 32 is a side cross-sectional view showing a lighting unit 100C according to a fourth embodiment. In the description of the fourth embodiment, the first embodiment is referred for the same components as those in the first embodiment and the repeated description is omitted.

Referring to FIG. 32, a reflective plate 155 is disposed on the substrate 110 of the light emitting unit 101. The reflective plate has LED holes 155A not to cover the LEDs 120 while covers the regions where the LEDs 120 are not exposed on the substrate 110. Therefore, some of the light emitted from the LEDs 120 can be reflected from the reflective plate 155, such that the amount of reflected light increases and light efficiency is improved. The reflective plate 155 is not necessarily a separate member from the substrate 110 and the upper surface of the substrate 110 may replace the reflective plate 155 by increasing reflective ratio of the upper surface of the substrate 110. Further, a diffusion material may be applied to the upper surface of the reflective plate 155.

The gap member 130 is disposed between the substrate 110 and the flange 144 of the lens 140 to space the substrate 110 and the lens 140 by a predetermined gap G1. The space 105 is defined between the lens 140 and the substrate 110, light emitted from the LEDs 120 is diffused in the space 105 between the substrate 110 and the lens 120, and the diffused light can be diffused through the prism surface 142 and the furrow surface 141 of the lens 140.

Meanwhile, the other configuration is the same as the fourth embodiment shown in FIG. 32 the gap member 130 described in the first embodiment may replace the gap member 130 of the fourth embodiment, which is a fifth embodiment (not shown). In the fifth embodiment, both withstand voltage and light efficiency are improved in the same was as the effect of the gap member 130 described in the first embodiment, and the reflective plate 155 used in the fourth embodiment is used, such that the light efficiency can be more improved.

A lighting device including the lighting unit 100 is described hereafter.

<Lighting Device Including Lighting Unit>

Figure 33:
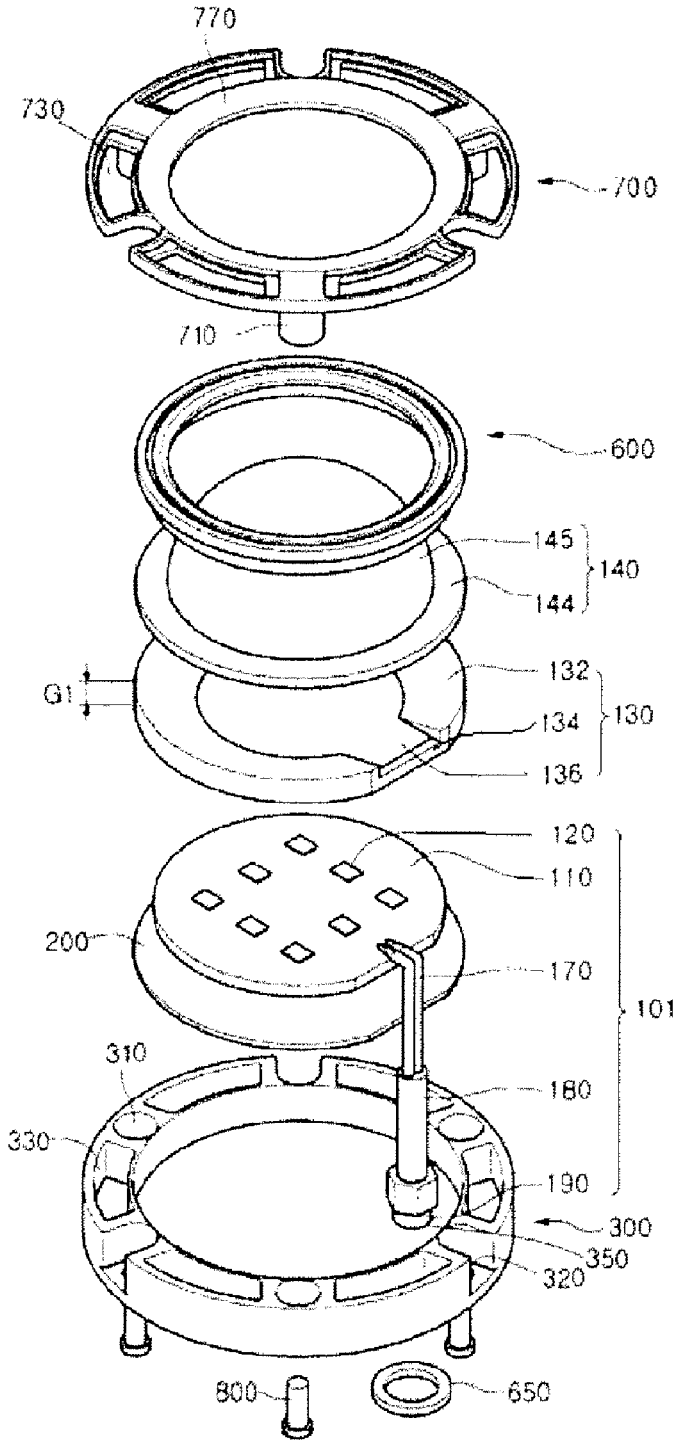
FIG. 33 is an exploded perspective view of a lighting device according to a sixth embodiment.
Figure 34:
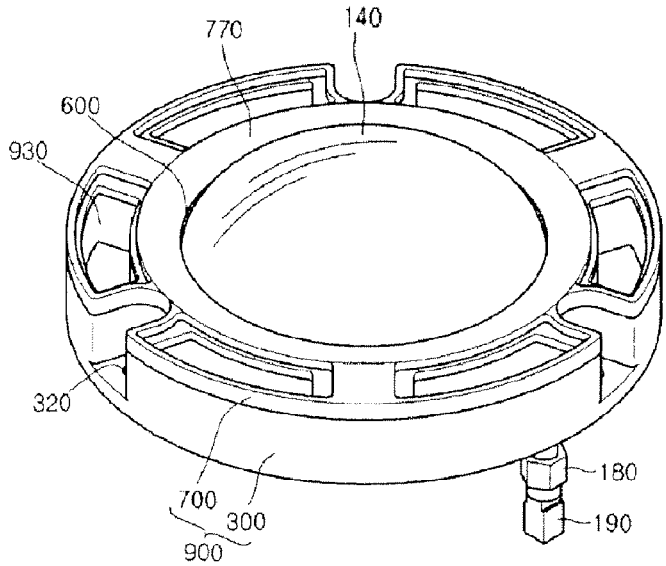
FIG. 34 is a perspective view of a lighting device according to the sixth embodiment, seen from above.
Figure 35:
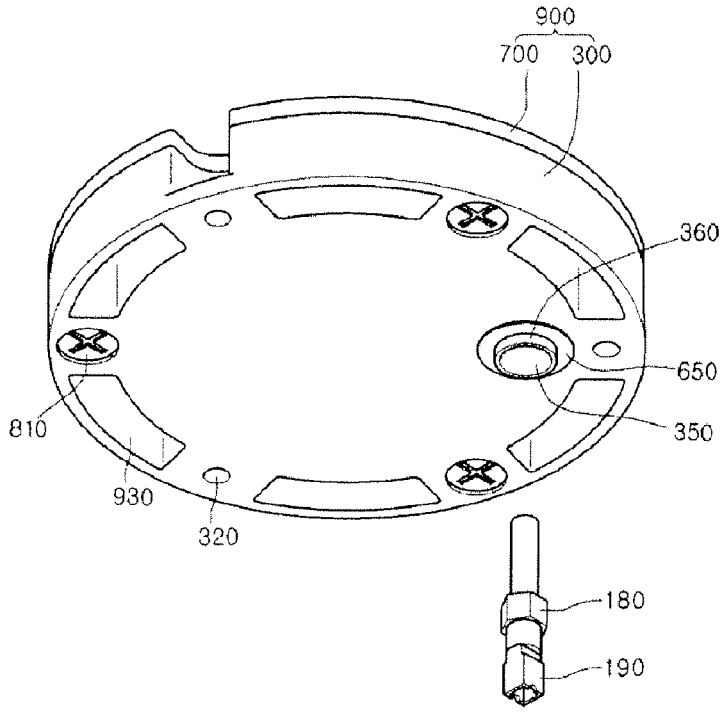
FIG. 35 is a perspective view of the lighting device according to the sixth embodiment, seen from below.
Figure 36:
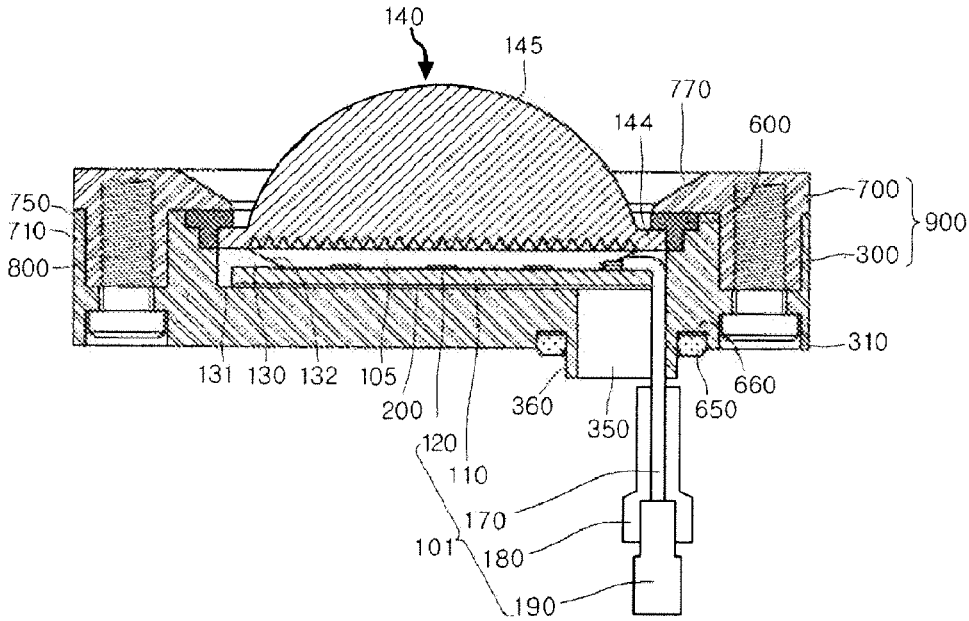
FIG. 36 is cross-sectional view of the lighting device according to the sixth embodiment.
Figure 37:
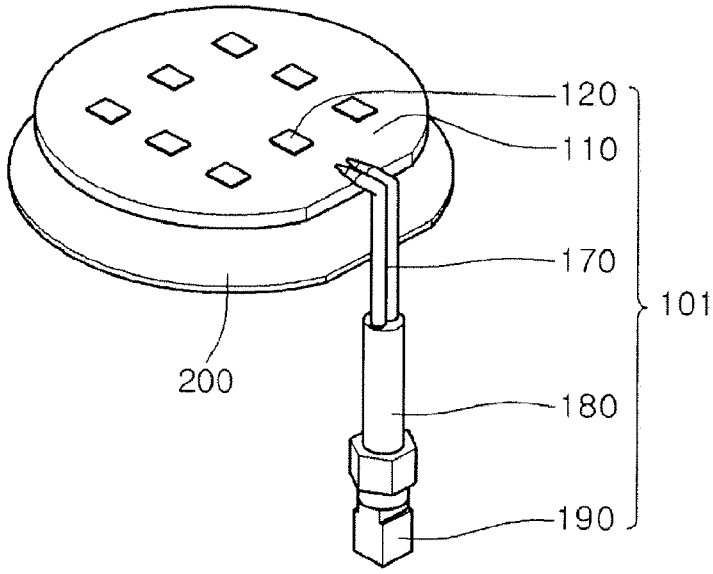
FIG. 37 is a view showing a light emitting unit of a lighting device.

FIG. 33 is an exploded perspective view of a lighting device according to a sixth embodiment. FIG. 34 is a perspective view of a lighting device according to the sixth embodiment, seen from above. FIG. 35 is a perspective view of the lighting device according to the sixth embodiment, seen from below, and FIG. 36 is cross-sectional view of the lighting device according to the sixth embodiment. FIG. 37 is a view showing a light emitting unit of the lighting device.

Referring to FIGS. 33 to 36, a lighting device 10 according to the sixth embodiment includes a case body 300, a heat dissipation plate 200 in an inner groove of the case body 300, a light emitting unit 101 on the heat dissipation plate 200, a gap member 130 on the light emitting unit 101, a lens 140 on the gap member 130, a first waterproof ring 600 on the flange 144 of the lens 140, and a case cover 700 on the first waterproof ring 600 and the case body 300.

The case body 300 and the case cover 700 are combined and fixed by screws. Together, they form the case 900 of the lighting device.

The heat dissipation plate 200 dissipates heat generated from the light emitting unit 101.

The light emitting unit 101 may include a substrate 110, a plurality of LEDs 120 mounted on the substrate 110, and a lead electrode 170 transmitting power to the LEDs 120.

The lead electrode 170 is partially exposed to the outside through a through-hole 350 formed through the bottom of the case body 300 to be electrically connected with an external power source.

A protective tube 180 may be provided to cover the exposed portion of the lead electrode 170, in order to protect the exposed lead electrode 170 from the external environment, such as heat and humidity. A connecting terminal 190 is formed at the lower end of the lead electrode 170 such that the lead electrode 170 is connected to the external power source through the connecting terminal 190.

The lens 140 makes it possible to achieve desired discharge light distribution by adjusting the light distribution generated from the light emitting unit 101.

The gap member 130 forms a space between the lens 140 and the light emitting unit 101 by a predetermined gap G1. This results in the desired light emitting angle and it induces the desired light diffusion. The gap also accommodates the light emitting diodes mounted on the substrate of the light emitting unit.

The first waterproof ring 600 is disposed between the case cover 700 and the lens 140 to prevent moisture from getting into the lighting device 10.

A second waterproof ring 650 may be formed on the outer circumference of the through-hole 350 on the bottom of the case body 300 to prevent moisture from getting inside the lighting device 10 through the through-holes 350 when the lighting device 10 is attached to an external support member.

<Sixth Embodiment>

Hereafter, the lighting device 10 according to the sixth embodiment is described in detail.

Referring to FIGS. 33 to 36, the case body 300 may have a circular body with a space therein, that is, an inner groove. Further, the case cover 700 is shaped to correspond to the case body 300, having a circular ring shape with an opening.

The case body 300 and the case cover 700, when fixed to one another, form the case 900, as illustrated, for example, in FIG. 36. The case 900 serves as the body of the lighting device 10 and accommodates, for example, the heat dissipation plate 200, the light emitting unit 101, the gap member 130, the lens 140, and the first waterproof ring 600.

More specifically, the heat dissipation plate 200 is disposed in the space (i.e., the inner groove) of the case body 300. The light emitting unit 101 is disposed on the heat dissipation plate 200. The gap member 130 is, in this exemplary embodiment, ring-shaped, and it is disposed on and generally around the upper portion of the light emitting unit 101. The lens 140 is disposed on the gap member 130, such that the gap member 130 provides a space between the lens 140 and the light emitting unit. The space, among other things, accommodates the one or more light emitting diodes that are mounted on the substrate of the light emitting unit, as mentioned above. The first waterproof ring 600 is disposed on the flange 144 of the lens 140, and the case cover 700 is disposed on the first waterproof ring 600 and it is fixed to the case body 300, as explained above. In this configuration, the lens 140 projects through the opening of the case cover 700, as shown, for example, in FIG. 33.

Meanwhile, the shape of the case 900, in this exemplary embodiment, is circular. However, the case 900, that is, the case body 300 and the case cover 700, may be circular, rectangular, elliptical, polygonal or other take on other shapes as needed or desired.

The case 900 is preferably made of a material having good heat dissipation properties, that is, metal, for example one of aluminum (Al), nickel (Ni), copper (Cu), silver (Au), and tin (Sin). Further, the surface of the case 900 may be plated.

Alternatively, the case 900 may be made of resin.

The circumference of the case body 300 has an inner wall and an outer wall, and first hole 310, a second hole 320, and a first heat dissipation hole 330 may be formed between the inner wall and the outer wall.

Further, the circumference of the case cover 700 also has an inner wall and an outer wall, and a protrusion 710 and a second heat dissipation hole 730 may be formed between the inner wall and the outer wall.

In this configuration, the outer walls of the circumferences of the case body 300 and the case cover 700 may not be formed where the second hole 320 is formed.

Referring to FIG. 36, the protrusion 710 may have a screw groove 750 and is inserted in the first hole 310, the screw 800 is inserted in the screw groove 750 and the first hole 310, such that the case body 300 and the case cover 700 can be firmly combined and fixed.

The screw 800 may be inserted, with the head down, into the screw groove 750 of the protrusion 710 of the case cover 700 through the first hole 310 of the case body 300. Since the screw 800 is inserted through the first hole 310, the screw 800 is not exposed on the upper surface of the case cover 700. However, the insertion of the screw 800 may be modified in various ways.

As described above, since the case 900 can be combined or separated by the screws 800, when a fault occurs in the lighting device 10, the maintenance can be easily performed by inserting or removing the screws 800.

It is possible to fasten the lighting device 100 to a desired external support member, such as a street lamp or a vehicle lamp, by inserting a screw into the second hole 320 of the case body 300. In this configuration, the outer walls may not be formed where the second hole 320 is formed, in the circumferences of the case body 300 and the case cover 700, as described above, to easily insert the screw into the second hole 320.

The heat dissipation hole 930 of the case 900 is formed by the first heat dissipation hole 330 of the case body 300 and the second heat dissipation hole 730 of the case cover 700. The surface area of the case 900 is increased by the heat dissipation hole 930, such that the heat generated from the light emitting unit 101 can be effectively discharged, and the weight of the lighting device can be reduce as compared with when the heat dissipation hole 930 is not formed.

Referring to FIG. 35 and FIG. 36, the through-hole 350 may be formed through the bottom of the case body 300. A portion of the lead electrode 170 of the light emitting unit 101 is exposed to the outside through the through-hole 350 and connected to the external power source.

The through-hole 350 is formed such that the circumference 360 protrudes from the bottom of the case body 300. Since the circumference 360 of the through-hole 350 protrudes, the lighting device 10 can be accurately mounted to an external support member.

Further, the second waterproof ring 650 may be fitted around the outer circumference of the through-hole 360. The second waterproof ring 650 improves reliability of the lighting device 10 by prevent water from flowing into the lighting device 10 through the through-hole 350, when the lighting device 10 is attached to an external support member.

In this configuration, a ring groove 660 corresponding to the shape of the second waterproof ring 650 may be formed around the outer circumference of the circumference 360 of the through-hole 350.

Referring to FIGS. 33, 34, and 36, the inner side 770 of the case cover 700 may be inclined and accordingly the light emitted through the lens 140 can be effectively discharged. Further, the inner side 770 of the case cover 700 fixes the heat dissipation plate 200, the light emitting unit 101, the gap member 130, the lens 140, and the first waterproof ring 600 inside the case 900.

FIG. 37 shows the light emitting unit 101.

Referring to FIG. 33 and FIG. 37, the light emitting unit 101 may include a substrate 110, a plurality of LEDs 120 mounted on the substrate 110, and a lead electrode 170 transmitting power to the LEDs 120. The light emitting unit 101 supplies light to the lighting device 10.

The light emitting unit 101 is shaped to correspond to the shape of the inner groove of the case 900 to be accommodated in the case 900, in the circular plate, as shown in the figures, but is not limited thereto.

The substrate is an insulating member with a circuit printed and may be an aluminum substrate, a ceramic substrate, a metal core PCB, and a common PCB etc.

A color that efficiently reflects light, for example, white may be applied to the surface of the substrate 110.

The LEDs 120 may be mounted in an array on the substrate 110 and the arrangement and number of the LEDs 120 may be modified in various ways, if needed.

The LEDs 120 may be light emitting diodes. As the light emitting diodes, red LEDs, blue LEDs, green LEDs, and white LEDs may be selectively used and various other arrangements can be used.

The lead electrode 170 has one end connected to the substrate 110 and the other end exposed to the outside through the through-hole 350 formed through the bottom of the case body 300 to be electrically connected with an external power source.

A protective tube 180 may be provided to cover the other end of the lead electrode 170, in order to protect the exposed lead electrode 170 from the external environment, such as heat and humidity, and a connecting terminal 190 is formed at the other end of the lead electrode 170 such that the lead electrode 170 is connected to the external power source through the connecting terminal 190.

Meanwhile, the substrate 110 may be further provided with a DC converter that converts alternating current into direct current supply it, or a protective element that protects the lighting device 10 from electrostatic discharge or surge.

The heat dissipation plate 200 may be attached to the bottom of the light emitting unit 101. The heat dissipation plate 200 can discharge the heat generated from the light emitting unit 101 to the outside of the case 900.

The heat dissipation plate 200 is made of a thermal conductive material, and for example, may be any one a thermal conductive silicon pad or a thermal conductive tape.

The lens 140 has the exit surface 145 and the flange 144. The exit surface 145 adjusts discharge light distribution of the light generated from the light emitting unit 101 and discharges the light. The exit surface 145 is exposed through the opening of the case cover 700, such that the light can be discharged.

The flange 144 may be formed in a circular ring shape around the bottom of the exit surface 145 and the first waterproof ring 600 is dispose on the flange 144.

The lens 140 may be formed by injection-molding a light transmissive material, and the material may be glass and plastic, such as PMMA (Poly methyl methacrylate) and PC (Polycarbonate). Although the lens 140 is shown in a semi-spherical shape, all of the lenses 140 having various shapes described above can be used in the lighting device 10.

Further, the lens 140 can be easily replaced by a lens having desired discharge light distribution by separating the case body 300 from the case cover 700. Therefore, the lighting device can be used for various purposes.

The first waterproof ring 600 is disposed on the flange 144 of the lens 140.

Referring to FIG. 36, the first waterproof ring 600 may be formed in a circular ring shape to cover the upper surface and the circumference of the flange 144. That is, as shown in the figure, the first waterproof ring 600 may be disposed between the flange 144 of the lens 140 and the inner side 770 of the case cover 700.

The first waterproof ring 600 may be made a waterproof material, for example, waterproof rubber or waterproof silicon.

The first waterproof ring 600 fills the space between the lens 140 and the case cover 700 while covering the upper surface and the circumference of the flange 144, such that water cannot flow into the lighting device through the space and the reliability of the lighting device is improved.

Referring to FIG. 35 and FIG. 36, the second waterproof ring 650 may be disposed around the outer circumference of the circumference of the through-hole 350 formed through the bottom of the case body 300. The second waterproof ring 650 improves reliability of the lighting device 10 by prevent water from flowing into the lighting device 10 through the through-hole 350, when the lighting device 10 is attached to an external support member.

In this configuration, the ring groove 660 may be formed around the outer circumference of the circumference 360 of the through-hole 350.

The second waterproof ring 650 may be made a waterproof material, for example, waterproof rubber or waterproof silicon.

<Seventh Embodiment>

Hereafter, the lighting device 10 according to the seventh embodiment, mainly the components, are described in detail. In the description of the seventh embodiment, the sixth embodiment is referred for the same components as those in the sixth embodiment and the repeated description is omitted.

Figure 38:
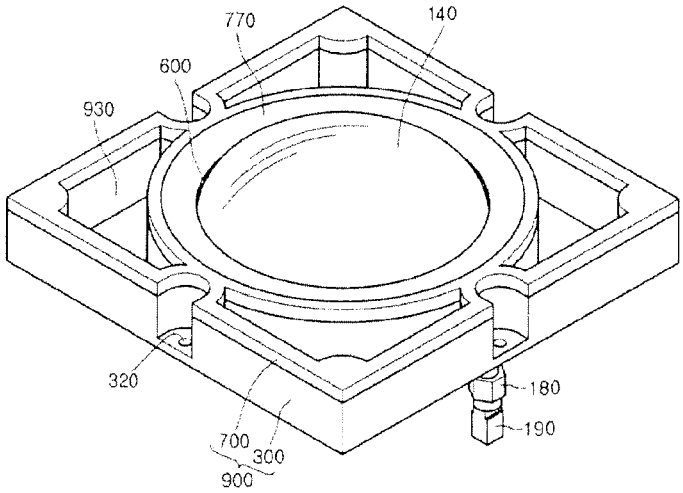
FIG. 38 is a perspective view of a lighting device according to a seventh embodiment, seen from above.

FIG. 38 is a perspective view of a lighting device according to a seventh embodiment, seen from above.

Referring to FIG. 38, the case body 300 has a rectangular body having a space, that is, an inner groove. Further, the case cover 700 is formed in a rectangular ring shape, corresponding to the shape of the case body 300.

The case body 300 and the case cover 700 are combined, such that the case 900 having the rectangular shape is formed. The case 900 forms the body of the lighting device 10 and accommodates the heat dissipation plate 200, the light emitting unit 101, the gap member 130, the lens 140, and the first waterproof ring 600 etc.

That is, the case 900 can be modified in various shapes within the scope of the present invention. For example, the shape of the case 900 may be a circle, a rectangle, a polygon, and an ellipse.

<Eighth Embodiment>

Hereafter, the lighting device according to the eighth embodiment, mainly the components, are described in detail. In the description of the eighth embodiment, the sixth embodiment is referred for the same components as those in the sixth embodiment and the repeated description is omitted.

Figure 39:
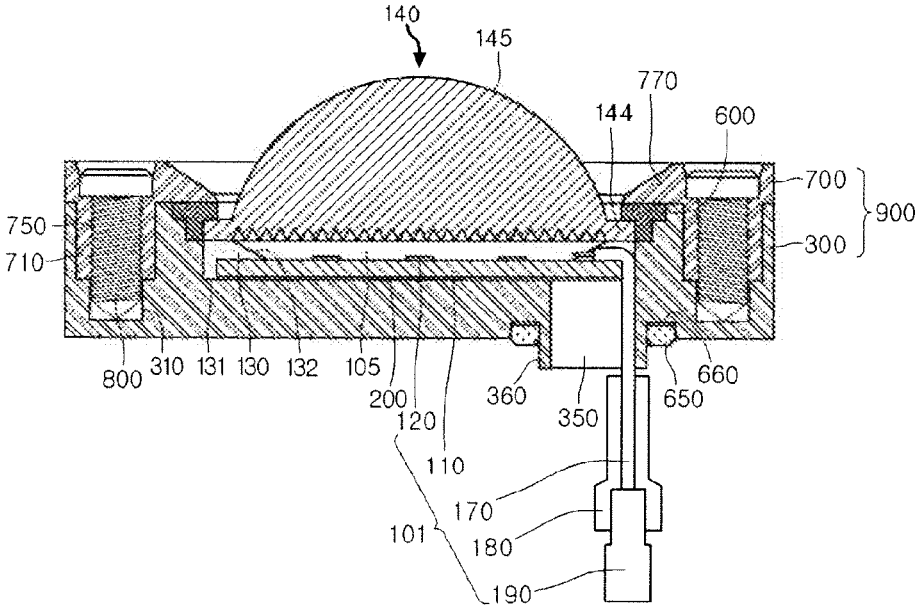
FIG. 39 is cross-sectional view of a lighting device according to an eighth embodiment.

FIG. 39 is cross-sectional view of a lighting device according to the eighth embodiment.

Referring to FIG. 39, the circumference of the case body 300 has an inner wall and an outer wall, and a first hole 310, a second hole (not show), and a first heat dissipation hole (not shown) may be formed between the inner wall and the outer wall.

Further, the circumference of the case cover 700 also has an inner wall and an outer wall, and a protrusion 710 and a second heat dissipation hole (not shown) may be formed between the inner wall and the outer wall.

Referring to FIG. 39, the protrusion 710 may have a screw hole 750 and is inserted in the first hole 310, the screw 800 is inserted in the screw hole 750 and the first hole 310, such that the case body 300 and the case cover 700 can be firmly combined and fixed.

The screw 800 may be inserted, with the head up, into the first hole 310 of the case body 300 through the screw hole 750 of the protrusion 710 of the case cover 700. As described above, the screw 800 is exposed on the upper surface of the case cover 700 by inserting the screw 800 through the screw hole 750, such that the screw 800 can be easily inserted or removed.

Therefore, when a fault occurs in the lighting device 10, the maintenance is easily performed by inserting or removing the screw 800.

Meanwhile, the method of combining and fixing the case cover 700 and the case body 300 is not limited to the sixth embodiment and the eighth embodiment and may be modified in various ways.

<Ninth Embodiment>

Hereafter, the lighting device 10 according to the ninth embodiment, mainly the components, are described in detail. In the description of the ninth embodiment, the sixth embodiment is referred for the same components as those in the sixth embodiment and the repeated description is omitted.

Figure 40:
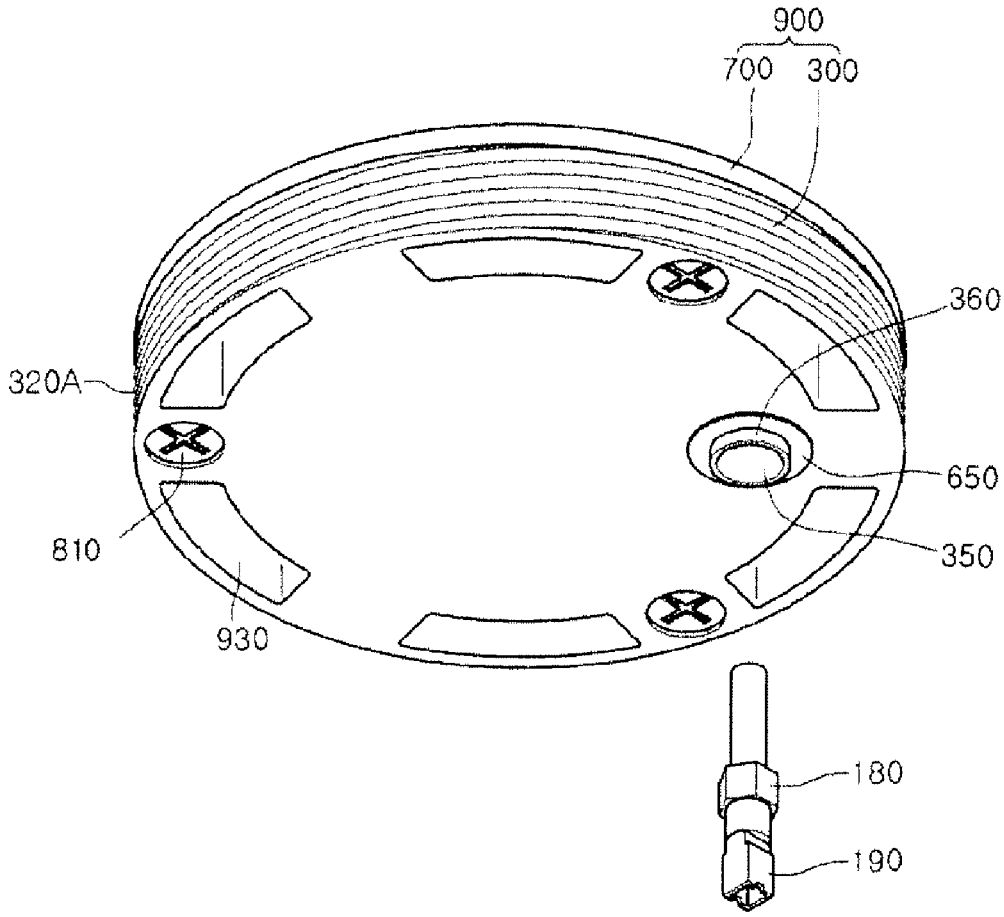
FIG. 40 is a perspective view of a lighting device according to a ninth embodiment, seen from above.

FIG. 40 is a cross-sectional view of a lighting device according to the ninth embodiment.

Referring to FIG. 40, the case body 300 has a body having a space, that is, an inner groove. Further, the case cover 700 is formed in a ring shape, corresponding to the shape of the case body 300.

The case body 300 and the case cover 700 are combined, such that the case 900 is formed. The case 900 forms the body of the lighting device 10 and accommodates the heat dissipation plate 200, the light emitting unit 101, the gap member 130, the lens 140, and the first waterproof ring 600 etc.

Meanwhile, in the ninth embodiment, a thread 320A is formed on the circumference of the case 900, instead of the second hole 320 formed to attach the lighting device 100 to a wall etc. in the sixth embodiment. The lighting device can be fastened to an external support member, such as a wall, a street lamp, and a vehicle, if needed, by the thread 320A.

That is, a threaded groove (not shown) corresponding to the thread (320A) may be formed where the lighting device is attached to an external support member, such as a wall, a street lamp, and a vehicle, such that the lighting device 10 can be attached to the external support member, such as a wall, a street lamp, and a vehicle, by fitting the thread 320A into the threaded groove (not shown).

Therefore, it is possible to attach the lighting device 10 to the external support member, such as a wall, a street lamp, and a vehicle, without using a screw.

Meanwhile, the method of attaching the lighting device 10 to the external support member, such as a wall, a street lamp, and a vehicle, is not limited to the methods described in the sixth embodiment and the ninth embodiment, and may be modified in various ways.

Although preferred embodiments of the present invention were described above, theses are just examples and do not limit the present invention. Further, the present invention may be changed and modified in various ways, without departing from the essential features of the present invention, by those skilled in the art. For example, the components described in detail in the embodiments of the present invention may be modified. Further, differences due to the modification and application should be construed as being included in the scope and spirit of the present invention, which is described in the accompanying claims.

What is claimed is:

1. A lens comprising:

a circular incident surface perpendicular to the light axis, the incident surface including a furrow surface traversing a center portion of the incident surface in a longitudinal direction, and a prism surface on both sides of the furrow surface; and an exit surface that reflects and refracts light from the incident surface.

2. The lens according to claim 1, wherein the cross-sectional shape of the furrow surface is round in a plane perpendicular to the longitudinal direction.

3. The lens according to claim 1, wherein the cross section of the prism surfaces reflects a plurality of triangular shapes in a plane perpendicular to the longitudinal direction.

4. The lens according to claim 1, wherein the width of the furrow surface is 9%~40% of the diameter of the incident surface.

5. The lens according to claim 1, wherein the exit surface is spherical.

6. A lens comprising:

a circular incident surface perpendicular to the light axis; and an exit surface that reflects and refracts light from the incident surface, thereby producing a radiation surface, wherein the incident surface comprises a luminance reinforcement surface traversing a center portion of the incident surface in a longitudinal direction and a light diffusion surface on both sides of the luminance reinforcement surface, wherein the luminance reinforcement surface is configured to concentrate light at a central portion of the radiation surface, and wherein the light diffusion surfaces are configured to diffuse light at an outer portion of the radiation surface.

7. The lens according to claim 6, wherein the cross-sectional shape of the luminance reinforcement surface is round in a plane perpendicular to the longitudinal direction.

8. The lens according to claim 6, wherein the cross section of the light diffusion surfaces reflects a plurality of triangular shapes in a plane perpendicular to the longitudinal direction.

9. The lens according to claim 6, wherein the width of the luminance reinforcement surface is 9%~40% of the diameter of the incident surface.

10. The lens according to claim 6, wherein the exit surface is spherical.

11. The lens according to claim 7, wherein the light diffusion surface is further configured to produce a radiation surface having an outer portion that is substantially rectangular.

12. The lens according to claim 11, where the length of the long side of the substantially rectangular radiation surface is at least 2.5 times the distance from a light source to a center portion of the radiation surface, and wherein the length of the short side of the substantially rectangular radiation surface is at least 1.6 times the distance from the light source to the center portion of the radiation region.

13. The lens according to claim 11, wherein the uniform pool to rectangular target ratio (UP/RT) is 0.88.

14. A lens comprising:

a circular incident surface that is perpendicular to a light axis; and an exit surface that reflects and transmits light traveling through the incident surface so as to produce a radiation surface, the radiation surface having a shape that is substantially rectangular, wherein the length of the long side of the substantially rectangular radiation surface is at least 2.5 times the height from the light source to the radiation surface, wherein the length of the short side of the substantially rectangular radiation surface is at least 1.6 times the height from the light source to the radiation surface, and wherein the uniform pool to rectangular target ratio (UP/RT) is 0.88.

15. The lens according to claim 14, wherein the furrow surface is curved.

16. The lens according to claim 14, wherein the cross section of the prism surface comprises a plurality of triangular shapes when the lens is cut along a plane perpendicular to the longitudinal direction of the furrow surface.

17. A circular light emitting device comprising:

a lens;

a light emitting unit; and a ring-shaped gap member having an opening there through, the gap member positioned between the lens and the light emitting unit, wherein the gap member comprises:

a ring-shaped reflective portion having a first surface substantially facing the lens, where the first surface slopes away from the lens as it extends inward thereby forming, at least in part, the space between the lens and the light emitting unit; and a ring-shaped wall portion that forms, at least in part, the periphery of the gap member, wherein the wall portion and the reflective portion are coaxial.

18. The light emitting device according to claim 17, wherein the gap member further comprises:

a flat lateral portion.

19. The light emitting device according to claim 18, wherein the light emitting unit comprises:

a flat lateral portion, wherein the position of the flat lateral portion of the light emitting unit corresponds with the flat lateral portion of the gap member.

20. The light emitting device according to claim 17, wherein the ring-shaped reflective portion forms the opening through the gap member, wherein the opening is circular, wherein the ring-shaped wall portion has an inner circumferential surface, and wherein the diameter of the circular opening formed by the ring-shaped reflective portion is less than the diameter of the inner circumferential surface of the wall portion.

21. The light emitting device according to claim 20, wherein the ring-shaped reflective portion has a second surface facing away from the lens, and wherein the second surface of the ring-shaped reflective portion and the wall portion together form a receiving space for seating the light emitting unit.

22. A light emitting device comprising:

a lens;

a light emitting unit; and a gap member having an opening there through, the gap member configured such that a space is formed between the lens and the light emitting unit, wherein the gap member comprises:

a reflective portion having a first surface substantially facing the lens and sloping away from the lens as it extends inward such that it reflects light towards the lens; and a wall portion, made of an insulating material, the wall portion, at least in part, forming the periphery of the gap member.

23. The light emitting device according to claim 22, wherein the space formed between the lens and the light emitting unit is configured to accommodate one or more light emitting diodes associated with the light emitting unit.

24. The light emitting device according to claim 23, wherein the opening through the gap member is configured such that light from the one or more light emitting diodes can pass through the gap member in the direction of the lens.

25. A lighting device comprising:

a light emitting unit that includes:

a substrate, and one or more light emitting diodes mounted on the substrate;

a lens;

a gap member forming a space between the lens and the light emitting unit, the space accommodating the one or more light emitting diodes;

a waterproofing ring disposed on a peripheral portion the lens;

a case cover having an opening there through, where the lens projects through the opening; and a case body, wherein the case body together with the case cover fix the waterproofing ring, the lens, the gap member, and the light emitting unit there between.

26. The lighting device according to claim 25, further comprising:

a heat dissipation plate disposed between the light emitting unit and the case body.

27. The lighting device according to claim 25, wherein the gap member comprises a reflective portion having a first surface substantially facing the lens, where the first surface slopes away from the lens as it extends inward thereby forming, at least in part, the space between the lens and the light emitting unit.

28. The lighting device according to claim 27, wherein the gap member further comprises a wall portion that forms, at least in part, the periphery of the gap member.

29. The lighting device according to claim 28, wherein the reflective portion has a second surface facing away from the lens, and wherein the second surface of the reflective portion and the wall portion together form a receiving space for accommodating the light emitting unit.

30. The lighting device according to claim 25, wherein the case body comprises an inner wall that forms a space to accommodate the light emitting unit.

31. The lighting device according to claim 25, wherein the case body and the case cover each include at least one heat dissipation hole through a peripheral portion thereof.

32. The lighting device according to claim 25, wherein the peripheral portion of the lens includes a flange, and wherein the waterproofing ring is disposed between the flange and a peripheral portion of the case cover.

33. The lighting device according to claim 25, wherein the shape of the case body and the case cover is any one of a circle, a rectangle, a polygon, and an ellipse.

* * * * *